United States Patent [19]

Tanasawa et al.

[11] 4,237,836

[45] Dec. 9, 1980

[54] FUEL SUPPLY SYSTEM EMPLOYING ULTRASONIC VIBRATORY MEMBER OF HOLLOW CYLINDRICALLY SHAPED BODY

[75] Inventors: Yasusi Tanasawa, Nagoya; Norio Muto, Aichi; Akinori Saito, Nagoya, all of Japan

[73] Assignee: Kabushiki Kaisha Toyota Chuo Kenyusho, Aichi, Japan

[21] Appl. No.: 904,897

[22] Filed: May 11, 1978

[51] Int. Cl.[3] ..... F02M 27/08

[52] U.S. Cl. .....123/537 261/DIG. 48

[58] Field of Search ..... 123/119 E, 119 EE, 141; 261/DIG. 48, 81

[56] References Cited

U.S. PATENT DOCUMENTS

| | | | |
|---|---|---|---|
| 2,213,928 | 9/1940 | Gold | 123/32 JV |
| 4,082,070 | 4/1978 | Saufferer | 123/119 E |
| 4,085,717 | 4/1978 | Willmann | 123/119 E |
| 4,105,004 | 8/1978 | Asai | 123/119 EE |

*Primary Examiner*—Ronald H. Lazarus
*Attorney, Agent, or Firm*—Oblon, Fisher, Spivak, McClelland & Maier

[57] ABSTRACT

According to the present invention, there is provided a fuel supply system employing an ultrasonic vibratory member of a hollow cylindrically shaped body, comprising a fuel tank for storing fuel therein; a pressurizing and regulating means for pressurizing the fuel supplied from the fuel tank to a predetermined pressure level and regulating the flow rate of the fuel; an ultrasonic wave generating means comprising an ultrasonic wave transducer connected to an ultrasonic wave oscillator for transforming an electric oscillation into mechanical vibrations, a mechanical vibration amplifying portion which is integrally secured to the ultrasonic wave transducer, and an ultrasonic vibratory member of a hollow cylindrically shaped body, having a predetermined length and diameter, which is integrally secured to an output end of the mechanical vibration amplifying portion, with the axis of the member being directed perpendicularly to the axis of the mechanical vibration amplifying portion; and liquid film forming means, connected to the pressurizing and regulating means, having an exit provided at the position adjacent to the ultrasonic vibratory member of the hollow cylindrically shaped body, forming a thin film of supplied fuel and supplying the fuel film from the exit to the ultrasonic vibratory member of the hollow cylindrically shaped body.

34 Claims, 38 Drawing Figures

FUEL SUPPLY SYSTEM EMPLOYING ULTRASONIC VIBRATORY MEMBER OF HOLLOW CYLINDRICALLY SHAPED BODY

BACKGROUND OF THE INVENTION

1. Field of the Invention

This invention relates to a fuel supply system employing an ultrasonic vibratory member of a hollow cylindrically shaped body.

2. Description of the Prior Art

An ultrasonic vibratory member of a hollow cylindrically shaped body affords the advantage of providing an extremely increased amount of atomized fuel, because of an extremely wide atomizing surface, as compared with an atomizing means using the end of an ultrasonic wave horn as an atomizing surface, and another type atomizing means in which a disc member is secured to the tip of the ultrasonic wave horn of the type described, so that fuel may be atomized on a circular surface of the disc member.

Hitherto, however, it has been a general practice for supplying fuel to a vibratory member of a hollow cylindrically shaped body to supply fuel to one spot on each of the inner and outer peripheral surfaces of the ultrasonic vibratory member, or to two or more positions corresponding to nodes of vibrations on the inner and outer peripheral surfaces of the vibratory member at the time of ultrasonic vibrations. Therefore, the prior art fuel supply systems provide a danger that in case an excessive amount of fuel is supplied instantaneously, part of the fuel fails to be atomized, but is repelled back from the surface of the vibratory member. In addition, in case an extremely small amount of fuel is supplied, the fuel tends to be supplied in the form of large drops, thus failing to reach an atomizing surface of the vibratory member, resulting in incomplete atomization of fuel. In addition, fuel is supplied to a specific spot or spots, resulting in corrosion and short service life.

Meanwhile, major items of requirements for an automotive internal combustion engine are (1) improvement in fuel consumption, (2) emission control of exhaust gases, and (3) improvement in drivability. To meet these requirements, various attempts have been proposed for modification of engines. The most important factor affecting the aforenoted requirements is a method for supplying fuel to an engine. What is of the supreme importance to this end is to provide fuel in the form of droplets as fine as possible, thereby achieving thorough mixing of air with atomized fuel. This may minimize the amount of fuel required for combustion chambers, without clinging of fuel to the inner surfaces of an intake manifold and the like, thereby improving fuel consumption. In addition, the condition of combustion may be improved to a degree to enable complete combustion, thereby minimizing the amounts of carbon monoxide and unburned hydrocarbons, i.e., harmful constituents of exhaust gases, which are produced due to incomplete combustion. Still furthermore, the flow speeds of fuel and air become almost constant, so the engine response may be improved, with an accompanying improvement in drivability.

Furthermore, upon cold starting, an automotive gasoline engine, as the Otto engine, remains as a whole at a low temperature with the result of a poor vaporization of the fuel. For example, in some cases, the air-fuel ratio admitted into the cylinder (combustion chamber) becomes 20, even in the case where the fuel has been supplied through a carburetor or a fuel injector at an air-fuel ratio of about 13. In such cases, a liquid of excessive fuel flows along the inner wall surfaces of the intake pipe and reaches the cylinder with a certain time delay. Therefore, it has been necessary either to provide a choke and idle fuel supply system for a carburetor or to add a cold start injector in the case of a fuel injection system, to thereby supply a mixture of an air-fuel ratio of 8 to enable supply of a mixture of air-fuel ratio of about 13 to the cylinder during a cold start.

In the operating range of the engine from warming up to low r.p.m. and low load, it is difficult to maintain an intended air-fuel ratio since the total flow rate of fuel is too small to enable its precise measurement. In addition, the flow rate of air is insufficient to atomize the fuel into fine droplets of suitable sizes.

These factors necessarily lead directly to increased fuel consumption, uneven air-fuel ratio distribution among respective cylinders, wide variations in air-fuel ratio in terms of time, impaired combustion, poor drivability and emission of harmful gases.

During engine operations under conditions other than the above-mentioned conditions, the control of the fuel flow is easier, as the amount of the intake air and the flow rate of the fuel are increased with an increase in load. However, it is still desired to preclude the flow of fuel in the form of liquid from the viewpoints of the engine response and the inter-cylinder air-fuel ratio distribution which exerts a great influence on emission of harmful gases.

Throughout all operating conditions of an Otto cycle engine, it is a pressing need to remove the liquid flows of the fuel along the inner surfaces of the intake pipe between the fuel supply system and an intake valve by atomizing such fuel into droplets of suitable sizes, and this invention contemplates to provide a solution to this problem.

SUMMARY OF THE INVENTION

It is accordingly an object of the present invention to provide a fuel supply system which avoids the aforenoted shortcomings in the prior art systems by providing extremely fine droplets of fuel which in turn is mixed with air thoroughly.

Another object of the present invention is to provide a fuel supply system employing an ultrasonic vibratory member of a hollow cylindrically shaped body, simply referred to hereinafter as a ring type vibratory member, which is simple in construction, provides high reliability and durability, and allows the atomization of fuel even in the case where the flow rate of the fuel varies to a large extent, depending on a variation in load, as in the case of an automotive internal combustion engine, and which supplies fuel in the form of a liquid film onto the inner and/or outer peripheral surface of the ring type vibratory member, so that the aforenoted ring vibratory member may function at a high efficiency and that there is provided a fuel supply system well adapted for use, for example, in an automotive internal combustion engine.

Still another object of the present invention is to provide a fuel supply system which includes, among others, an intake air control means, an ultrasonic vibratory member of a hollow cylindrically shaped body and a fuel injection means, in which turbulence of the intake air is suppressed to provide a smooth air flow, whereby atomized fuel thoroughly mixed with air is supplied without clinging to the walls of the intake air passage.

A further object of the present invention is to provide a fuel supply system which includes, among others, a wall member which is disposed adjacently and coaxially with an ultrasonic vibratory member of a hollow cylindrically shaped body, for forming a fuel film and supplying the same to the ultrasonic vibratory member in a stable manner without being disturbed or discontinued by the air flow.

A still further object of the present invention is to provide a fuel supply system which ensures optimum combustion in all operating conditions of an engine, optimum fuel consumption, reduction in the amount of harmful exhaust gases and better drivability.

BRIEF DESCRIPTION OF THE DRAWINGS

Various other objects, features and attendant advantages of the present invention will be more fully appreciated as the same becomes better understood from the following detailed description when considered in connection with the accompanying drawings, in which.

DETAILED DESCRIPTION OF THE PREFERRED EMBODIMENTS

Figure 1:
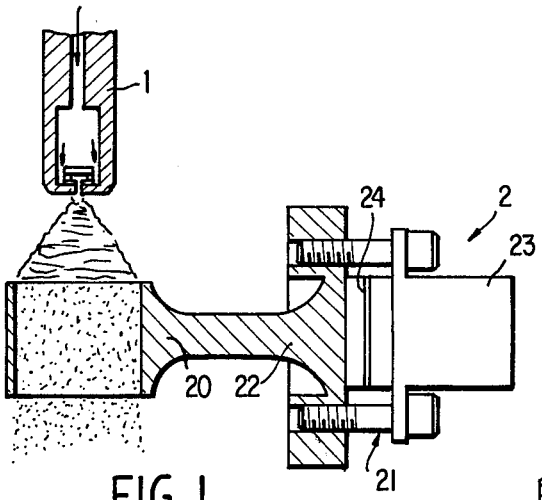
FIG. 1 is a sectional view illustrative of the principle of fuel atomization in the present invention.

According to the present invention, there is provided a fuel supply system employing an ultrasonic vibratory member of a hollow cylindrically shaped body, comprising a fuel tank for storing fuel therein; a pressurizing and regulating means for pressurizing the fuel supplied from the fuel tank to a predetermined pressure level and regulating the flow rate of the fuel; an ultrasonic wave generating means comprising an ultrasonic wave transducer connected to an ultrasonic wave oscillator for transforming an electric oscillation into mechanical vibrations, a mechanical vibration amplifying portion which is integrally secured to the ultrasonic wave transducer, and an ultrasonic vibratory member of a hollow cylindrically shaped body having a predetermined length and diameter, which is integrally secured to an output end of the mechanical vibration amplifying portion, with the axis of the member being directed perpendicularly to the axis of the mechanical vibration amplifying portion; and liquid film forming means, connected to the pressurizing and regulating means, having an exit provided at the position adjacent to the ultrasonic vibratory member of the hollow cylindrically shaped body, forming a thin film of supplied fuel and supplying the fuel film from the exit to the ultrasonic vibratory member of the hollow cylindrically shaped body.

With the fuel supply system according to the present invention, as thin film-like fuel is atomized by an ultrasonic vibratory member of a hollow cylindrically shaped body, it is possible to supply extremely fine droplets of fuel. Further, as the ultrasonic vibratory member of a hollow cylindrically shaped body has large atomizing surfaces, the present invention enables the atomization of a great amount of fuel.

According to the first aspect of the present invention, there is provided a fuel supply system employing an ultrasonic vibratory member of a hollow cylindrically shaped body, comprising an air supply passage having an intake air control means for controlling the flow rate of the intake air; a fuel tank for storing fuel therein; a pressurizing and regulating means for pressurizing the fuel supplied from the fuel tank to a given pressure level and regulating the flow rate of the fuel; an ultrasonic wave generating means comprising an ultrasonic wave transducer connected to an ultrasonic wave oscillator for transforming an electric oscillation into mechanical vibrations, a mechanical vibration amplifying portion which is integrally secured to the ultrasonic wave transducer, and an ultrasonic vibratory member of a hollow cylindrically shaped body, which is integrally secured to an output end of the mechanical vibration amplifying portion, and has a given length and a given diameter, with the axis of the member being directed perpendicular to the axis of the mechanical vibration amplifying portion; and an injection means connected to the pressurizing and regulating means and having an exit in the close vicinity of a center axis of the ultrasonic vibratory member of a hollow cylindrically shaped body in the ultrasonic wave generating means, whereby fuel may be injected through the exit onto at least one of the inner and outer peripheral surfaces of the ultrasonic vibratory member of a hollow cylindrically shaped body in the form of a cone-shaped or a divergently spread liquid film.

With the fuel supply system according to this first aspect of the present invention, there is adopted an ultrasonic vibratory member of a hollow cylindrically shaped body having large atomizing surfaces, which enables the atomization of a great amount of fuel. Further, since the fuel is supplied in the form of a thin liquid film to the atomizing surfaces, i.e. to the inner and/or outer surfaces of the ultrasonic vibratory member of a hollow cylindrically shaped body, this system enables stable, consistent, and positive atomization of the fuel, i.e., extremely fine droplets of the fuel may be achieved, thus achieving complete combustion of fuel, improvement of fuel consumption, and reduction in the amount of unburnt harmful constituents of exhaust gases from an engine.

Furthermore, the system according to this first aspect of the present invention does not supply the fuel only to a specific spot or spots like the prior art fuel supply system, but supplies the fuel uniformly over the entire inner and/or outer peripheral surfaces of the vibratory member in the form of a liquid film, thereby preventing corrosion and thus improving the durability of the system.

Fuel supply systems employing carburetors for use in internal combustion engines of motor vehicles suffer from a tendency to fail to achieve desired atomization of fuel. In other words, with a carburetor, fuel is introduced into an air passage and atomized with the aid of intake air streams running into the air passage to produce an air-fuel mixture charge of a given air-fuel ratio. However, downstream of such portion of the air passage is usually positioned a throttle valve of a disc form adapted to control the amount of a mixture charge to be supplied by controlling the opening and closing of the air passage, with the result that there are created complicated reverse flow or swirls of intake air stream and a mixture charge stream. These adverse flow or swirls of streams hinder the desired vaporization or atomization of the fuel supplied in the carburetor, with the result that part of the fluid clings to the wall surface of the air passage in the form of a liquid fuel and then flows down therealong, while another part of the flow is turned into relatively large liquid droplets which in turn flow down and eventually impinge on an intake manifold, a throttle valve or the like in the form of a liquid, and in addition, still another part of the flow is mixed in the fine droplets with the intake air to be supplied to a combustion chamber of an engine.

Accordingly, fuel in the carburetor clings to the walls of an intake manifold, throttle valve or the like, so that particularly in the cold start of an engine, unless an excessive amount of fuel is supplied so as to compensate for the fuel thus clinging, there arises a failure in starting the engine. This leads to an increase in fuel consumption as well as the production of excessive amounts of harmful constituents of exhaust gases due to incomplete burning of unburnt hydrocarbons, carbon monoxide, and the like, resulting in pollution of the atmosphere. Furthermore, the fuel clinging to the wall surfaces of an intake manifold and the like flows down in the form of a liquid film, so that excessive time is required for the liquid, until the fuel is introduced into a combustion chamber of an engine, i.e., there arises delayed responsiveness of the fuel supply, for an engine. Still furthermore, a mixture charge to be supplied to a combustion chamber fails to afford an optimum air fuel ratio because of the aforenoted clinging fuel. This is particularly true with a multiple-cylinder internal combustion engine. In other words, there arises a lack of uniform distribution of a mixture charge to respective cylinders. If the case comes to the worst, there results troubles in stable and smooth running of an internal combustion engine.

Meanwhile, according to the fuel supply system for an internal combustion engine employing an ultrasonic vibratory member of a hollow cylindrically shaped body having large atomizing surfaces, the ultrasonic vibratory member has been placed on the downstream side of such a portion in a carburetor where a mixture charge is produced, while a throttle valve of the type described is placed likewise downstream thereof. Thus, the fuel may be atomized efficiently and positively by means of the aforenoted ultrasonic vibratory member. However, this only meets a partial success in the atomization of fuel, because of the aforenoted adverse influences by the aforenoted throttle valve, i.e., the atomized fuel tends to cling to the walls of the intake manifold or the throttle valve, thus resulting in the failure to provide complete atomization or vaporization of the fuel supplied, with the accompanying disadvantages of increased fuel consumption and undesirable running performance of the engine.

According to the second aspect of the present invention, there is provided a fuel supply system having an ultrasonic vibratory member of a hollow cylindrically shaped body, comprising an air supply passage having an intake air control means for controlling the flow rate of the intake air, through which air is fed, an intake air control means having at least one movable member placed in the air supply passage in a manner that the axis of the movable member is directed at a right angle to the axis of the air supply passage, the movable member being reciprocable, whereby the opening and closing of the air supply passage may be controlled so as to produce smooth flow of intake air in the form of parallel air streams running in the direction of the air supply passage, the intake air control means regulating the flow rate of the intake air; a tank for storing fuel therein; a pressurizing and regulating means for pressurizing the fuel fed from the tank to a given pressure level and regulating the flow rate of the fuel; an ultrasonic wave generating means including an ultrasonic transducer connected to an ultrasonic wave generating means for transforming electric oscillation into mechanical vibrations, a mechanical vibration amplifying portion integral with said ultrasonic transducer for amplifying the mechanical vibrations, and a hollow cylindrically shaped ultrasonic vibratory member positioned downstream of the intake air control means and secured integrally to an output end of the mechanical vibration amplifying portion, with the respective axes thereof being maintained at a right angle, the ultrasonic wave generating means having a given length and a diameter; and a fuel injection means positioned downstream of the intake air control means and connected to the pressurizing and regulating means, the fuel injection means having an opening or exit in the neighborhood of the center axis of the ultrasonic vibratory member of a hollow cylindrically shaped body in the ultrasonic wave generating means, whereby fuel may be supplied through the exit in the form of a conical or divergently spread liquid film onto at least one of the inner and outer peripheral surfaces of the ultrasonic vibratory member of a hollow cylindrically shaped body.

According to the fuel supply system of this second aspect of the present invention, there is used an intake air control means which may reciprocate substantially at a right angle to the center line of an air supply passage so as to control the opening and closing of the air supply passage, whereby there may be created a smooth flow of intake air in the air supply passage, in the form of parallel streams running in the axial direction of the air supply passage, and, in addition, the flow rate of intake air may be controlled with high accuracy, thereby facilitating the mixing of the intake air thus introduced with super-atomized fuel created by the ultrasonic vibratory member of the hollow cylindrically shaped body. Furthermore, the atomized fuel may be prevented from clinging to the walls of the fuel supply passage and enhanced in its smooth flow. As a result, the responsiveness of the fuel supply for an engine may be improved so as to achieve complete burning of a mixture charge. Still furthermore, production of harmful constituents of exhaust gases from an engine may be suppressed and the fuel consumption may be improved. Yet furthermore, the fuel supply system according to the second aspect of the invention provides the same effects as in the first aspect of the invention, such as stable, consistent and positive atomization of a large amount of fuel, and improved corrosion-resistance and durability of the system.

In the case where fuel is supplied in the form of a liquid film from the portion along the axis of the ultrasonic vibratory member of a hollow cylindrically shaped body to reach the peripheral wall thereof, it has been necessary to provide countermeasures for preventing the liquid film of fuel from being disturbed or discontinued by air which is passed through the hollow cylindrical body in an extremely large amount. As a result, in some cases, the mixing of atomized fuel and air has to be sacrificed to some extent.

According to one example of the third aspect of the present invention, there is provided a fuel supply system employing an ultrasonic vibratory member of a hollow cylindrically shaped body, comprising: a fuel tank; an ultrasonic wave generating means including an ultrasonic transducer connected to an ultrasonic oscillator for transforming electric oscillations into mechanical vibrations, a mechanical vibration amplifying member integrally connected to the ultrasonic transducer for amplifying the mechanical vibrations, and an ultrasonic vibratory member of a hollow cylindrically shaped body of a given length and diameter, the vibratory member being integrally secured to the output end of the mechanical vibration amplifying member with the respective axes thereof being directed perpendicularly to each other and mounted substantially coaxially within an intake air passage; a wall member having a peripheral wall surface of a given length and having substantially the same diameter as that of at least either the inner or outer periphery of the ultrasonic vibratory member at such an end of the wall member which is disposed adjacently and coaxially with the ultrasonic vibratory member which is positioned in the intake air passage; and a pressurizing and regulating means communicated with the fuel tank and adapted to regulate the flow rate of the fuel and pressurize the fuel to a given pressure level before supplying same to at least either the outer or inner peripheral surface of the wall member through a nozzle provided therein.

With the above-described structure, the fuel is supplied at a regulated flow rate to the peripheral surface of the wall member through a nozzle which is provided therein, allowing the fuel to flow down in the form of a thin liquid film along the wall member for supplying the same to the ultrasonic vibratory member, which therefore can atomize the fuel in a stable and positive manner, by atomizing the fuel into extremely fine droplets optimum for mixing with air which is passed through the wall member and the ultrasonic vibratory member.

Further, free passage of air through the wall member and the hollow cylindrical body allows the fuel to be formed into a thin film and enhances the mixing of fuel with air which is passed through the member, supplying a uniform air-fuel mixture swiftly to a combustion means downstream thereof, thus attaining high response and appropriate air-fuel ratio throughout the entire running conditions of an engine, and realizing optimum combustion, improvement of fuel consumption, reduction of harmful exhaust gases and improvement of drivability.

In addition, the fuel supply system according to the first example of the third aspect of the present invention provides the same advantages as in the first aspect of the invention, such as stable, consistent and positive atomization of a large amount of fuel, and improved corrosion-resistance and durability of the system.

According to another example of the third aspect of the invention, there is provided a fuel supply system similar to that of the above-described first example, but different in that a wall member of a given length has a peripheral surface having an axially gradually reduced inner diameter, the wall member being positioned close to and coaxially with the ultrasonic vibratory member positioned in the intake air passage and the narrow outlet of the wall member having substantially the same diameter as the inner diameter of the ultrasonic vibratory member of the hollow cylindrically shaped body, the outlet of the wall member being disposed adjacent to the ultrasonic vibratory member.

The fuel supply system according to this example of the third aspect of the invention has advantages similar to those of the first example, and in additon an advantage that the air speed is increased due to the gradually reduced inner diameter of the wall member to achieve improved dragging or pressing force effects for the fuel flowing along the wall member, thus aiding in the formation of a film of fuel.

The fuel supply system according to the present invention will now be described in more detail in comparison with a prior art fuel supply system.

Figure 2:
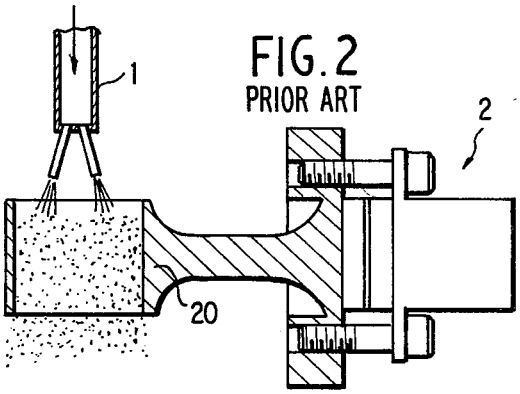
FIG.2 PRIOR ART
FIG. 2 is a sectional view illustrative of the principle of fuel atomization in a prior art fuel supply system.

FIG. 1 shows an ultrasonic wave generating means and part of an injection means, both of which constitute the essential part of the present invention. Fuel is injected through the injection means 1 in the form of a liquid film to be supplied to a ring type vibratory member 20 in an ultrasonic wave generating means 2. The advantage of supplying the fuel in the form of a liquid film to the ring type vibratory member will be described in comparison with the prior art fuel supply system. The ring type vibratory member 20 provides large vibratory surfaces, thereby attaining uncomparably excellent atomizing capability of the fuel, as compared with those of other types of vibratory members. However, with this vibratory member, there is a given limitation on a method for supplying fuel. In other words, in case the fuel is supplied to spots undergoing vibrations of the maximum amplitude (antinodes of vibrations), then the fuel will be repelled back from the vibratory surfaces of the vibratory member, thereby failing to atomize the fuel. Accordingly, the fuel should be supplied to spots undergoing vibrations of a zero amplitude (nodes of vibrations). FIG. 2 refers to the aforenoted method in which, when the ring type vibratory member undergoes 4th order flexural vibrations, there are created four nodes of vibrations. Therefore, the fuel is supplied in the form of four jet streams. This method is simple, but disadvantageous for the following reasons as a fuel supply system for use in an automotive internal combustion engine. Namely, the automotive internal combustion engine suffers from a large variation in load, so the flow rate of fuel varies from 0.2 g/s in an idle running condition to 5 g/s at the time of the maximum output condition. Accordingly, even if the fuel jet streams are desired to be supplied in a manner as shown in FIG. 2, there is a possibility of fuel reaching the vibratory surfaces in an insufficient amount, as well as a possibility of fuel impinging on the vibratory surfaces in an excessive amount at a high speed, so that the fuel is repelled from the vibratory surfaces of the member. Accordingly, there arises a difficulty in supplying fuel to the vibratory surfaces of the member in a consistent manner. To avoid this, there is proposed an attempt to supply fuel to the vibratory surfaces intermittently. However, to inject the jet stream of fuel onto the vibratory surfaces, the fuel should be injected at a somewhat high speed, so that there is posed a problem in achieving desired atomization of the fuel without repelling by the vibratory surfaces, when the fuel is injected to or impinges on the vibratory surfaces at the aforenoted speed required.

Meanwhile, according to the method as shown in FIG. 1, in which there is used a fuel supply system adapted to supply fuel in the form of a liquid film, the thickness of the fuel film to be supplied to vibratory surfaces is several tens $\mu$, thereby avoiding a need to supply the fuel to the positions of nodes of vibrations, on the surfaces of the vibratory member, for achieving desired atomization of the fuel. In addition, the speed of the spreading of a liquid film is much slower, as compared with that of the aforenoted fuel jet streams, and there is no danger of the fuel being repelled from the vibratory surfaces of a vibratory member. Unlike the case where fuel is injected onto four nodes of vibrations at four spots on the surfaces of a ring type vibratory member, the fuel supply system employing a fuel film supplying method is much advantageous in improved corrosion-resistance and durability, because the entire inner peripheral surface of a vibratory member is employed.

As has been thus far described, the fuel film supply method for supplying fuel onto the surface of a ring type vibratory member according to the present invention has not been achieved by the prior art fuel jet stream supply system. The fuel supply system according to the present invention is well adapted for use in an automotive internal combustion engine, while the prior art ring vibratory member could not have met success in attaining the full capacity of the ring type vibratory member. Description will now be turned to means for supplying fuel to a ring type vibratory member in the form of a liquid film.

Figure 3A:
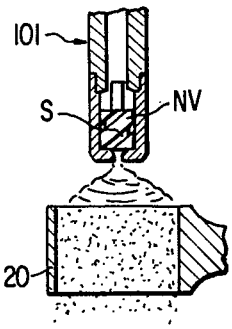
FIGS. 3 to 8 are sectional views showing various modifications of fuel injectors according to the present invention.
Figure 3B:
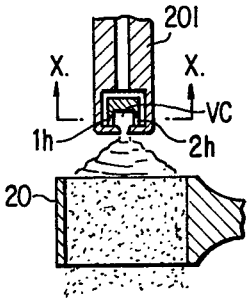
Figure 3C:
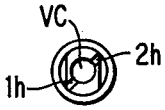
Figure 4:
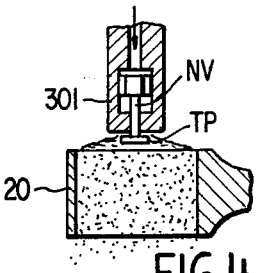

FIG. 3 refers to a swirl type injector 101 serving as a liquid film producing means, in which a spiral groove S is provided in a needle valve NV so as to create a swirl of a cone-shaped fuel film, i.e. a liquid film in the form of a diverging spray of fuel, as shown in FIG. 3(*a*). FIG. 3(*b*) shows a swirl type injector 201, in which one or more openings or jets 1*h*, 2*h* are provided in the wall of a vortex chamber VC of a cylindrical shape in the tangential direction thereof, whereby fuel is injected through the aforenoted jets so as to create a swirl of fuel. These instances are not provided in a limitative sense, so various types of swirl type injectors may be employed, as far as a swirl of a fuel film may be created. FIG. 4 refers to an impingement type injector 301 as one of the measures to produce a liquid film. According to the impingement type injector 301, fuel may be injected at a high speed through a clearance around the needle valve NV so as to allow the jet streams of fuel on a top surface TP of a needle so as to create diverging spray of a dishshaped fuel film.

Figure 5A:
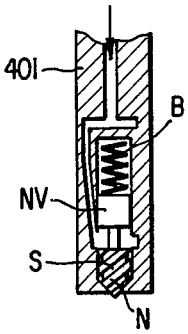
Figure 5B:
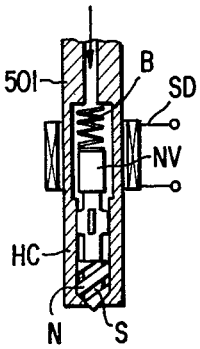
Figure 6A:
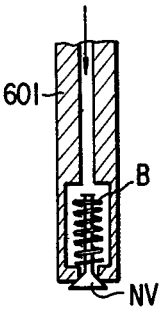
Figure 6B:
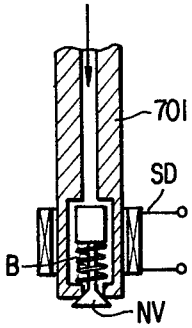
Figure 7A:
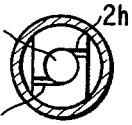
Figure 7D:
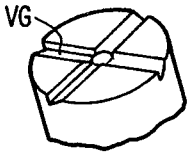
Figure 7B:
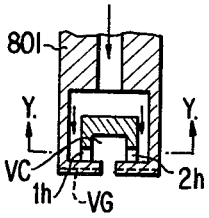
Figure 7E:
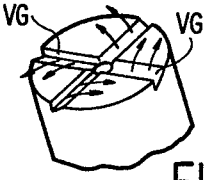
Figure 7F:
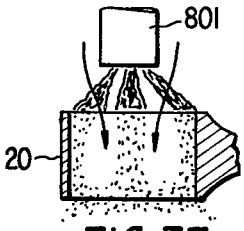
Figure 7C:
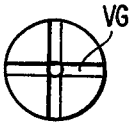

The aforenoted liquid producing means may all produce a liquid film continuously. According to the present invention, as shown in FIGS. 5 and 6, fuel may be injected intermittently so as to create atomized fuel or minute particles of fuel. This, however, provides another advantage in that air may be introduced during the time that the fuel injection is being interrupted, thereby enhancing the mixing of air with atomized fuel. FIGS. 5(*a*), 6(*a*) both show automatic injectors 401, 602, in which a nozzle N is normally closed by a needle valve NV under the action of a spring B, and only when the fuel pressure is built up to a given level is fuel injected in the form of a liquid film against the biasing force of a spring B. FIGS. 5(*b*), 6(*b*) both show injectors 501, 701, in which a needle valve NV may be intermittently driven by a solenoid SD against the action of the spring B. FIG. 5 refers to swirl type injectors 401, 501, while FIG. 6 refers to the impingement type injectors 601, 701, all of which are of an intermittently fuel-injection type.

Figure 8A:
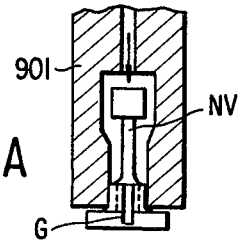
Figure 8C:
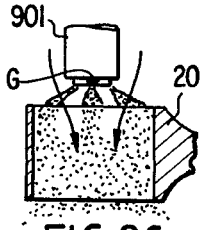
Figure 8B:
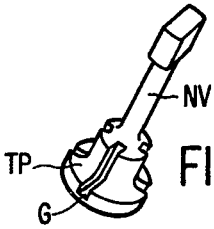

FIGS. 7 and 8 show examples wherein a fuel film is divided so that air may pass through gaps thus provided for improving the mixing of air with fuel particles. FIG. 7 refers to a swirl type injector 801, wherein grooves VG of a 'V' shaped cross section are provided in the end surface of the injector, as shown in (a) to (d) of FIG. 7, so that the directions of fuel being injected are defined as shown in (e) of FIG. 7, in an attempt to divide a fuel film as shown in (f) of FIG. 7. FIG. 8 illustrates a method to divide a liquid film in an impingement type injector 901. As shown in (b) of FIG. 8, grooves G are provided in a top flat surface TP of a needle NV, thereby dividing a liquid film as shown in (c) in FIG. 8 by defining the directions of fuel jet streams.

Description will now be made of an example of the fuel supply system according to the present invention for use in an automotive internal combustion engine.

Figure 9:
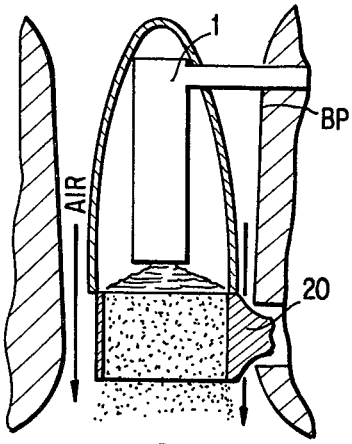
FIGS. 9 and 10 are sectional views illustrative of examples of arrangements, in an intake air passage of a fuel injector and a ring type vibratory member in an ultrasonic wave generating means according to the present invention.
Figure 10:
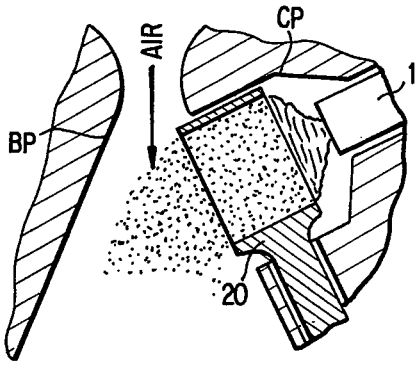

With this example, as shown in FIG. 9, a bottomed hollow cylindrical cover of a 'U' shaped cross section is placed so as to cover an injection means 1 serving as a liquid film producing means, upstream of the injection means 1 within a venturi portion BP of an intake air passage, so that the liquid film may not be hindered by air streams and the flow of air may be effectively directed, in an attempt to rapidly mix the fuel droplets atomized by the ring type vibratory member 20 so as to be supplied to a combustion chamber (not shown). FIG. 10 illustrates an example of the invention, in which a cavity CP is provided in a venturi portion BP in an inclined direction to the venturi portion BP, with a ring type vibratory member being attached therein so as to create a consistent or stable fuel film and achieve thorough mixing of air with fine fuel droplets, because the vibratory member is positioned in a portion where the air is flowing at a high speed.

Description will be made of another example of a ring type vibratory member according to the present invention.

Figure 11:
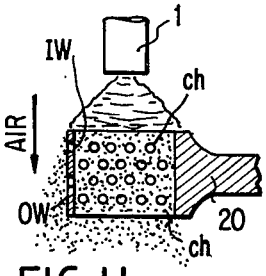
FIG. 11 is a sectional view showing a modification of the ring type vibratory member in the ultrasonic wave generating means according to the present invention.

As shown in FIG. 11, two or more minute round openings or jets ch are provided at an equal spacing in a vibratory surface of the ring type vibratory member 20, so that part of the fuel supplied in the form of liquid film to an inner peripheral surface IW of the ring alone may penetrate to an outer peripheral surface OW thereof for atomization. Accordingly, even in case a fuel film is supplied only to one of the peripheral surfaces of the vibratory member 20, the fuel may be atomized on both peripheral surfaces, thereby enabling an increase in the vibratory surface with the resulting enhancement of fuel atomizing capability of the vibratory member 20, in addition to improved mixing of fine fuel droplets with air flowing along the outer peripheral surface of the vibratory member 20.

Figure 12:
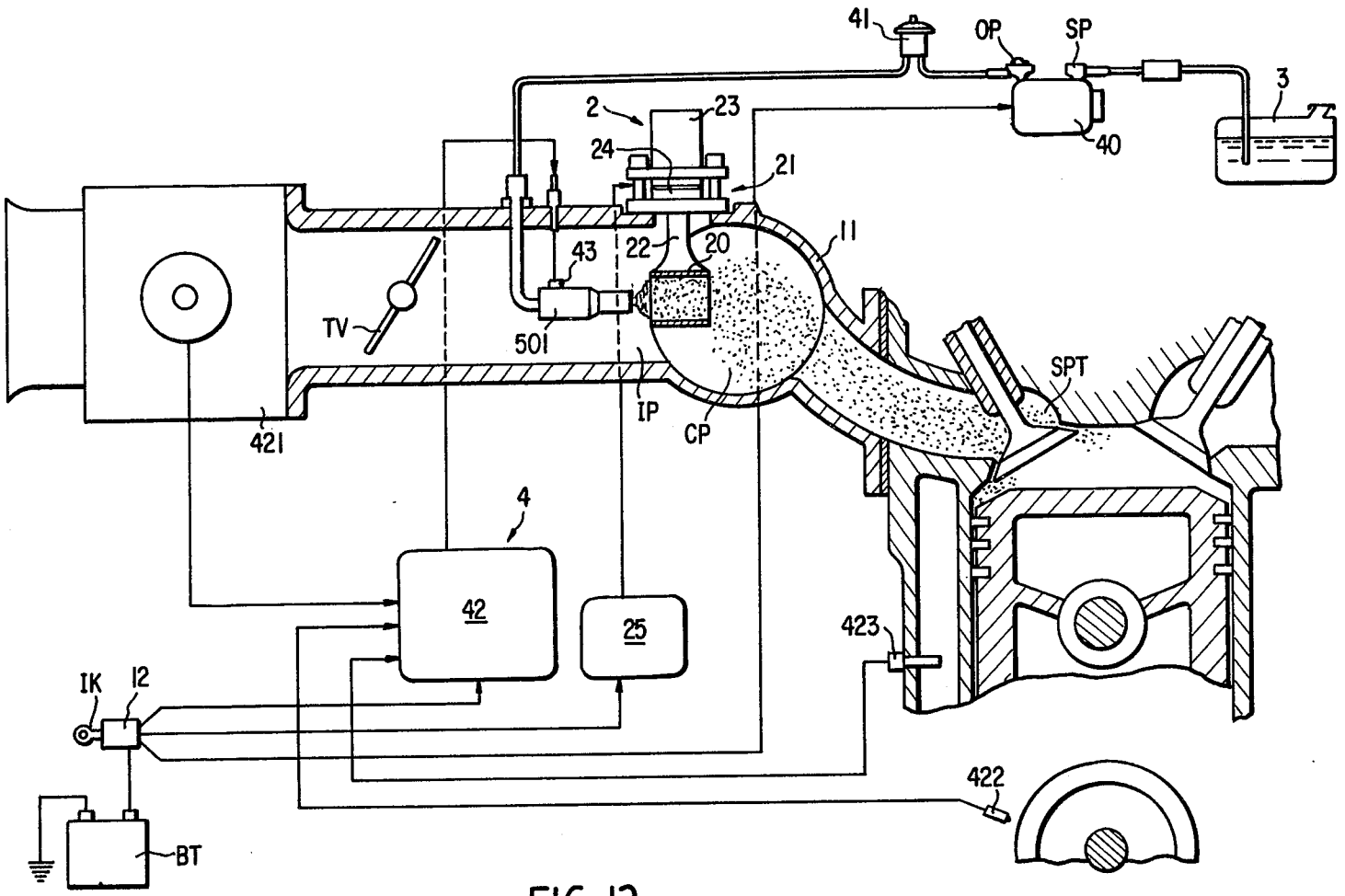
FIG. 12 is a schematic view showing a fuel system according to a first embodiment of the present invention.

The present invention will further be described of a fuel supply system for use in an automotive internal combustion engine, which employs an ultrasonic vibratory member of a hollow cylindrical shape, according to the first embodiment of the invention (the first aspect), with reference to FIGS. 12, 1 and 5(*b*).

The features of the fuel supply system according to the first embodiment lie in the provision of an injection means 1 for creating a fuel film, i.e., an intermittently injecting fuel injector 501 adapted to create a fuel film intermittently, as shown in FIG. 5(*b*) and that the opening duration and opening cycles of the aforenoted injector may be controlled commensurate to the running condition of an internal combustion engine, thereby allowing the intermittent supply of fuel in a given flow rate commensurate to the running condition of an engine to the ring type vibratory member 20 in the form of a liquid film.

The fuel supply system according to the first embodiment of the invention includes: a fuel tank 3 positioned in the rear portion of a motor vehicle; a pressurizing and regulating means 4 for pressurizing the fuel to a given pressure level and regulating the flow rate of the fuel; an intermittently injecting fuel injector 501 positioned downstream of a throttle valve TV in an intake air passage in coaxial relation to the intake air passage; and an ultrasonic wave generating means 2 positioned downstream in the close vicinity of the injector 501.

The pressurizing and regulating means 4 comprises: a pump 40 driven by a motor and having a suction port SP connected via a filter and pipes to the aforenoted fuel tank; a pressure regulating valve 41 connected to a discharge port DP of the pump 40 for controlling the pressure of fuel being fed from the pump 40 to a given pressure level; a computer 42; and a solenoid 43 provided on the injector 501 and adapted to control the opening and closing of a needle valve by an electromagnetic force, in response to a signal from the computer 42.

The computer 42 computes (i) a signal from an air flow sensor 421 positioned downstream of an air cleaner (not shown) provided on an intake air passage and adapted to deliver an electric signal commensurate to the amount of air introduced under suction into the intake passage, (ii) another signal from a r.p.m. sensor 422 adapted to deliver an electric signal commensurate to the r.p.m. of an engine by detecting the r.p.m. of the engine, and (iii) still another signal from a cooling-water-temperature sensor 423 positioned in a water jacket for a cylinder block of an internal combustion engine and adapted to deliver a signal commensurate to a temperature of engine cooling water, whereby the aforenoted computer 42 delivers a given pulse signal to the solenoid 43 positioned on the injector 501, thereby controlling the valve opening cycle and the valve opening duration of time, commensurate to the running condition of an engine.

As shown in FIG. 5(*b*), the solenoid 43 allows a needle valve NV to close the nozzle N under the action of the spring B in the injector 501. However, the solenoid 43 controls the opening and closing operations of the needle valve NV by an electromagnetic force, when a pulse signal is fed thereto from the computer 42, thereby controlling the valve-opening cycle and valve opening duration of time commensurate to the running condition of an engine so as to regulate the flow rate of fuel, thus allowing injector 501 to inject fuel to a ring type vibratory member in the form of a liquid film.

The intermittently injecting fuel injector 501, as shown in FIG. 5(*b*) includes a needle valve NV inserted into a hollow-cylinder HC having a bottom, in which a nozzle N is provided, with the tip portion of the needle valve NV having a spiral groove S, and with the other end portion of the valve NV being so loaded as to be biased in the axial direction by means of the spring B all of the time so as to close the nozzle N. Thus, when the solenoid 43 pushes the needle valve NV upwards in the axial direction, as shown, according to a pulse signal from the computer 42, the fuel receiving vortex energy due to the provision of the spiral groove S and thus regulated of its flow rate may be intermittently discharged from the nozzle N in the form of a cone-shaped fuel film of a thickness of several tens microns.

The ultrasonic wave generating means 2 comprises: a piezoelectric type ultrasonic wave transducer 21 having piezolelectric elements 24 of a pair of PZT (FIG. 1) sandwiched between a backing block 23 and a mechanical vibration amplifying portion 22 by means of a reinforcing ring and four bolts; the mechanical vibration ampliyfing portion 22 made of a stepped type horn and integrally secured to the ultrasonic wave transducer 21 by means of the aforenoted bolts; and an ultrasonic vibratory member 20 of a hollow cylindrical shape, which is integral with an output end of the mechanical vibration amplifying portion 22, with the respective axes thereof being perpendicular to each other.

The ultrasonic wave transducer 21 transforms an electric ultrasonic oscillation from an ultrasonic wave oscillator 25 into mechanical vibrations by means of a pair of PZT 24, the aforenoted oscillator 25 being adapted to start electric ultrasonic oscillation the moment an engine switch 12 is turned on.

With the mechanical vibration amplifying portion 22, a flange portion thereof having a large cross-sectional area is secured to the side wall of the intake air passage by means of the aforenoted bolts through the medium of a flange on the backing block 23, whereby supporting the entire ultrasonic wave generating means, and the ultrasonic vibratory member 20 of a hollow cylindrical shape is positioned in a collecting portion CP of an intake manifold along the center axis of the intake air passage IP coaxially but somewhat downstream of the injection valve 501.

As shown in FIG. 12 with respect to this embodiment, the intake air passage and intake manifold are so designed as to minimize the number of bends so as to prevent atomized fuel or fine fuel droplets from clinging to the bends.

According to this embodiment, an engine is started by means of an ignition key IK connected to a battery BT. However, this embodiment includes a relay means (not shown) insuring a predetermined sequence of operations, i.e., turning the ignition key on; driving the ultrasonic wave generator; driving the pump 40; starting the operation of the computer 42; and driving an engine starter.

According to the fuel supply system of the first embodiment having the aforenoted arrangement, the running condition of an engine is judged by the computer 42 provided in the pressurizing and regulating means 4, based on signals from the air flow sensor 421, r.p.m. sensor 422, and cooling-water-temperature sensor 423, i.e. based on the amount of intake air, engine r.p.m. and a cooling water temperature, with the result that the pulse width and pulse number of a pulse signal may be controlled so as to further control the valve-opening cycle and valve-opening duration of time for the injector 501. Then, fuel of a given amount commensurate to the running condition of an engine is intermittently injected through the nozzle N in the injector 501 in the form of a thin swirl-type liquid film, so that the fuel film supplied onto the entire inner peripheral surface of the ring-type vibratory member 20 in the ultrasonic wave generating means 2 may be atomized into extremely fine fuel droplets in the form of mist due to ultrasonic vibrations, after which the fuel droplets are thoroughly mixed with intake air introduced, in the aforenoted collecting portion CP and then the mixture thus prepared is supplied to respective cylinders of an engine through the intake air port SPT for complete combustion.

As is apparent from the description of the first embodiment, the entire amount of fuel supplied is turned into a thin liquid film by means of the injector 501, before supplying the fuel to a ring type vibratory member 20, so that there may be produced extremely fine droplets over a wide running range of an engine, and in addition the entire amount of the fuel supplied may be almost completely atomized. This feature of the first embodiment in much advantageous, as compared with a prior art engine in which a carburetor or a fuel injector suffers from the clinging of fuel to the intake air passage or intake air port. In addition, the atomizing percentage and atomizing amount of fuel are much superior to those of a prior art fuel supply system which supplies fuel to a given spot or spots.

Furthermore, since the fuel supply system according to this embodiment is positioned downstream of a throttle valve in an intake air passage, there arises no danger of fuel clinging to a throttle valve, after having been atomized by the ring type vibratory member 20, but the entire amount of atomized fuel may be supplied into a combustion chamber, without fuel clinging to the wall of an intake air passage, and the like.

Figure 13:
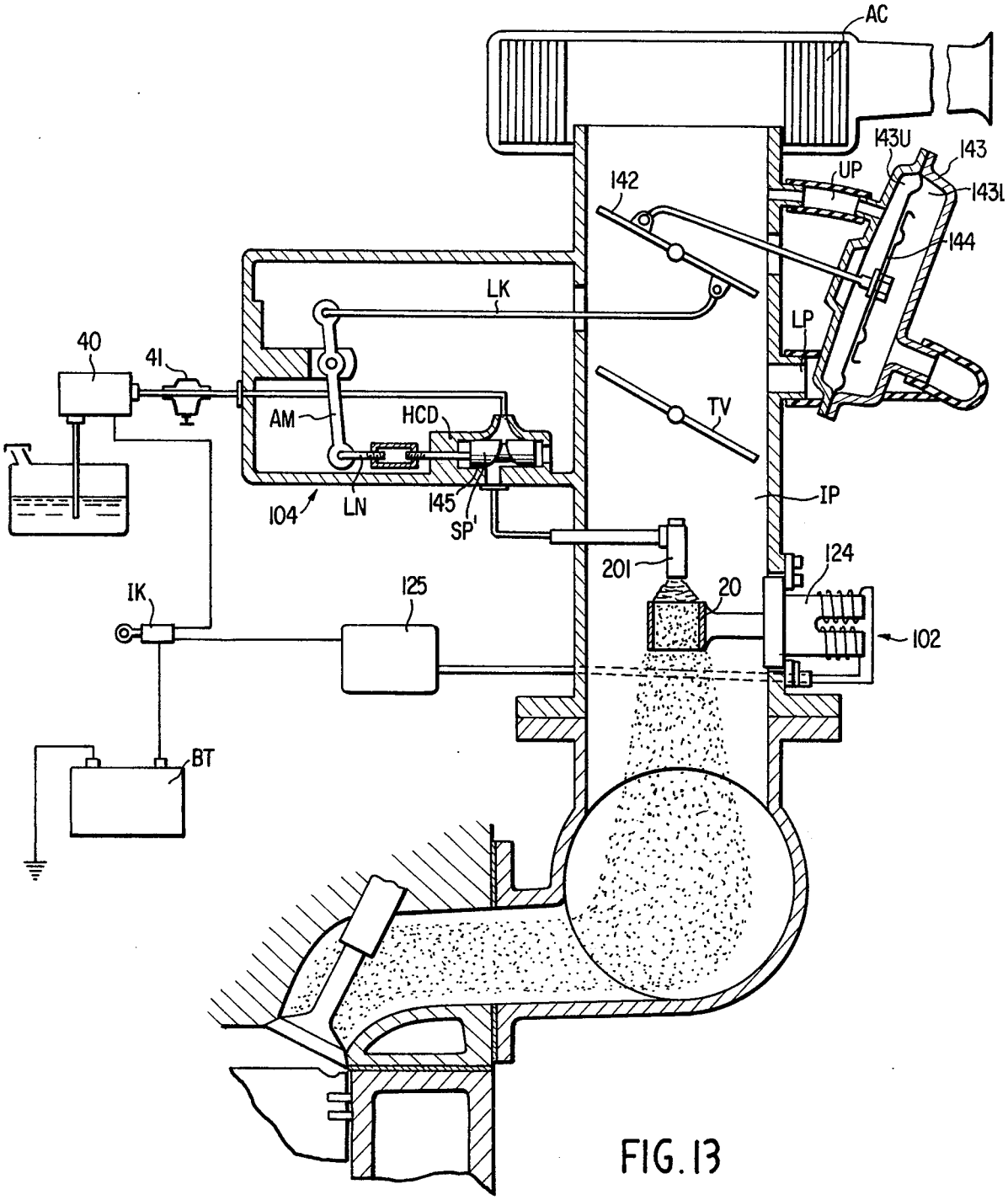
FIG. 13 is a schematic view showing a fuel supply system according to a second embodiment of the present invention.

The fuel supply system according to the second embodiment of the invention (the first aspect) which is applied to an internal combustion engine as in the first embodiment and employs a vibratory member of a hollow cylindrical shape will be described with reference to FIG. 13 and FIG. 3(*b*).

The marked difference of the fuel supply system according to the second embodiment, as compared with that of the first embodiment lies in the facts that fuel supply is continuously controlled and that the ultrasonic wave transducer in the ultrasonic wave generating means is a magnetostrictive ultrasonic transducer. However, like parts are designated like reference numerals and thus duplicate description will be avoided.

The fuel supply system according to the second embodiment consists of: a fuel tank 3; a pressurizing and regulating means 104 adapted to pressurize the fuel from the fuel tank 3 to a given pressure level and regulate the flow rate of fuel; an injection means 201 positioned downstream of a throttle valve in an intake air passage in coaxial relation to the intake air passage and continuously controlling the amount of fuel being injected, commensurate to the running condition of an engine; and an ultrasonic wave generating means 102 comprising a magnetostrictive transducer and positioned downstream in the close vicinity of the fuel injection means 201.

The pressurizing and regulating means 104 comprises: a pump 40; a pressure regulating valve 41, an air valve 142, a pressurizing chamber 143, and a flow rate regulating valve 145. The air valve 142 consists of a disc member which is rotatably supported in the intake air passage IP in a manner similar to a throttle valve TV, between an air cleaner AC and the throttle valve TC. The interior of the pressurizing chamber 143 is partitioned by a diaphragm 144 into an upper chamber 143U communicated with a passage UP which in turn is communicated with that part of the intake air passage which is upstream of the air valve 142, and a lower chamber 143L communicated with a passage LP which is communicated with that part of the intake air passage which is downstream of the air valve 142. As shown in FIG. 13, the diaphragm 144 has a rod of a small diameter, which is secured to the central portion of the diaphragm 144 by means of fastening means at one end thereof and coupled to the lefthand semi-circular portion of the air valve 142 of a disc form at the other end of the rod. A link LK is coupled to the righthand semi-circular portion of the air valve 142 at one end thereof as well as to an upper end portion of an arm AM at the other end of the link LK, the aforenoted arm AM being loaded by a spring. The flow rate regulating valve 145 consists of: a hollow cylinder HCD having suction and discharge ports; a spool SP′ fitted in the cylinder HCD and having a diverging groove extending along the circumference of the spool; and a link LN having a length-adjusting mechanism, secured to the spool SP′, and coupled to a lower end portion of the arm AM.

The fuel injector 201 consists of a swirl type injector, as shown in FIG. 3(*b*), and includes a cylindrical chamber VC of a small volume in coaxial relation to a nozzle provided in a bottom portion of a hollow cylinder HC, and two tangential passages 1*h*, 2*h* which are open into the cylindrical chamber VC in the tangential direction, with a passage leading to the tangential passages 1*h*, 2*h*, being communicated with a discharge port of the flow rate regulating valve 145 through a pipe of a given inner diameter. Accordingly, when fuel is introduced tangentially under a given pressure into the cylindrical chamber VC through the tangential passages 1*h*, 2*h*, then there is produced a vortex in the cylindrical chamber VC.

The ultrasonic wave generating means 102 is different from such means 2 of the first embodiment in that it comprises a magnetostrictive transducer 124 having a lead wire wound a given number of turns around leg portions of a 'U' type core, which is connected to an ultrasonic wave oscillator 125. The other parts of its arrangement are identical to those of the first embodiment, and hence description thereof is omitted. As in the first embodiment, the ring type vibratory member 20 is secured to the side wall of the intake air passage by means of bolts and a ring-shaped supporting member through the medium of an annular rigid member. Furthermore, the ring type vibratory member 20 is positioned along the center axis of the intake air passage in the close vicinity of and in coaxial relation to the injector 201.

The other parts of the second embodiment remain the same as those of the first embodiment.

In operation of the fuel supply system according to the second embodiment having the aforenoted arrangement, when the throttle valve TC is opened upon the running of an engine, the pressure prevailing downstream of the air valve 142 becomes lower than the pressure prevailing upstream of the valve 142, so that the diaphragm 144 is deflected, thus opening the air valve 142. Then, the link LK connected to the air valve 142 is moved, so that the spool SP' in the fuel flow regulating valve 145 is biased to the left in the axial direction through the medium of the link LN. As a result, an open area of the flow rate regulating valve 145 is enlarged, so that the flow rate of fuel supplied from the pump 40 via the pressure regulating valve 41 and then discharged from the valve 145 is increased, so the fuel is delivered to the injector 201 for injecting fuel in the form of a liquid film. Accordingly, the injector 201 continuously controls the flow rate of fuel commensurate to the running condition of an engine, while the fuel is supplied in the form of a liquid film to the inner peripheral surface of the ring type vibratory member 20 which undergoes ultrasonic mechanical vibrations. The ring type vibratory member 20 turns the fuel film thus supplied, into extremely fine fuel droplets, thereby enabling through mixing of fuel droplets with air, before supplying the fuel to a combustion chamber.

As in the first embodiment, the second embodiment allows the atomization of fuel into extremely fine droplets for thorough mixing with air, as well as the supply of fuel of a minimum amount required for combustion of a mixture charge in an engine, thus attaining the intended objects of the invention, i.e., improvement in fuel consumption, purification or emission control of exhaust gases, and improvement in drivability. In addition, the second embodiment provides other advantages which may be achieved by the first embodiment.

The fuel supply system according to the third embodiment of the present invention (the second aspect) will now be described in more detail with reference to FIGS. 14 and 15.

With the fuel supply system according to this embodiment, an intake air control means A, is positioned in an air supply passage 1001 adapted to supply air therethrough. The intake air control means A includes a movable member $a_1$ and a stationary member $a_2$, whose longitudinal sections and side surfaces are of convex shapes having given radii of curvatures suitable for introducing intake air efficiently, the movable member $a_1$ and stationary member $a_2$ being positioned in opposed relation to each other. An upper portion of a piston 1002 having the movable member $a_1$ is slidingly sealingly fitted in a cylinder 1004 defined within a cylindrical wall 1003 of the air supply passage 1001, with the axis of the movable member $a_1$ being perpendicular to the axis of the air supply passage 1001. Such an end of the piston 1002 which faces the botton portion of the cylinder 1004 is operably linked through a throttle wire 1005 to an accelerator pedal (not shown) in a motor vehicle. Accordingly, when the accelerator pedal is pushed down, the piston 1002 is lifted up by means of a throttle wire 1005. On the other hand, when the pedal is released, then the piston 1002 is lowered, so that the piston 1002 may reciprocate in the direction at a right angle to the center line of the air supply passage 1001. As shown in FIG. 14, the longitudinal sectional and side surface configurations of the lower end portion of the piston 1002, which face the air supply passage 1001 are of a convex shape having given radii of curvatures, thereby defining a throat 1006 in cooperation with a convex surface of the stationary member $a_2$. The openings of the throat 1006 both on its upstream and downstream sides, i.e., the openings of the air supply passage are of a variable rectangular shape in attempts to arrange the flow of intake air and to supply intake air in the form of parallel air streams along the length of the air supply passage 1001.

Figure 15:
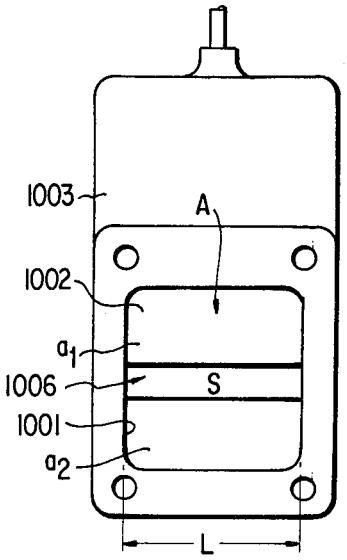

The cross sectional area S ($S=H\times L$) of an opening of the throat (as shown in FIG. 15) varies depending on a displacement H of the piston 1002. Meanwhile, the engine E may be regarded as a sort of a vacuum pump. An atmospheric pressure prevails in a front portion 1007 of the throat 1006, while a negative pressure prevails in a rear portion 1008 of the throat 1006. According to hydrodynamics, when the ratio of the pressure at the throat 1006 to the atmosphere reaches 0.53, the air velocity at the throat 1006 reaches the speed of sound. Accordingly, the mass flow $\dot{m}$ of air passing through the throat 1006 may be determined by multiplying the throat cross sectional area S by the sound speed C, and then multiplying the product by air density P, as given in an equation below:

$$\dot{m} = S \cdot K \cdot \frac{P_o}{\sqrt{T_o}}$$

wherein K represents a proportion constant, $P_o$ represents the atmospheric pressure, and $T_o$ the atmospheric temperature. It follows from this that the mass flow of air is proportional to the cross-sectional area S of the throat, and that the flow rate of air may be controlled by moving the piston 1002 in the throat 1006 up and down, thereby varying the displacement H of the piston for controlling an output of an engine E.

Figure 14:
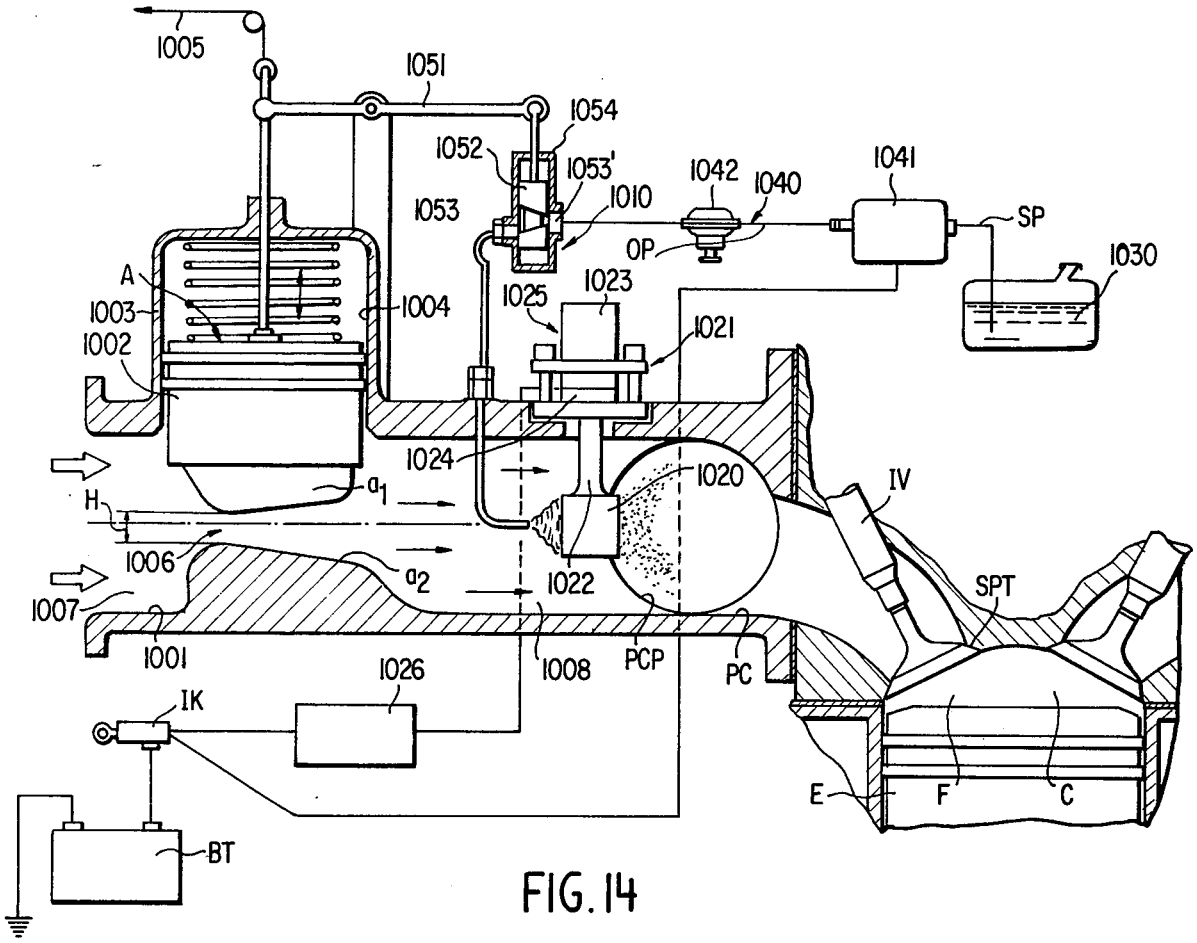
FIGS. 14 to 18 are views illustrative of the outline of a third embodiment of the present invention.
Figure 16:
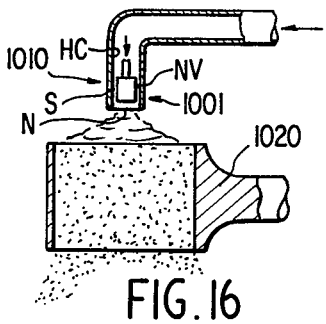

The fuel supply system according to this embodiment includes a fuel injection means 1010, as shown in FIGS. 14 and 16, adapted to create a fuel film and having a continuously injecting fuel injector 1601 adapted to create a fuel film continuously, whereby fuel may be supplied from the injector in a constant amount continuously and in the form of a liquid film to an ultrasonic vibratory member 1020 of a hollow cylinder, commensurate to the running condition of the engine.

The fuel supply system according to this embodiment comprises: a fuel tank 1030 positioned in the rear portion of a motor vehicle; a pressurizing and regulating means 1060 adapted to pressurize and regulate the fuel from the fuel tank 1030; a fuel injector 1601 positioned in the air supply passage downstream of the throat 1006 in coaxial relation to the air supply passage; and an ultrasonic wave generating means 1020 positioned in the close vicinity and on the downstream side of the fuel injector 1601.

The pressurizing and regulating means 1040 comprises a pump 1041 driven by a motor and having a suction port SP which is connected through a filter (not shown) and pipes to the fuel tank 1030; a pressure regulating valve 1042 adapted to control the pressure of fuel being fed from the pump 1041 to a given pressure level, by being connected to a discharge port OP of the pump 1041; and a fuel flow rate adjusting means 1054 communicated with the injector 1601 and controlling the opening and closing of flow paths 1053, 1053' by reciprocating a piston 1052 by means of a lever 1051 connected to a throttle wire 1005. As shown in FIG. 16, the continuously injecting fuel injector 1601 includes a needle valve NV in a hollow cylinder HC having a nozzle N and a bottom portion, while the needle valve NV has a spiral groove in its tip portion, whereby the needle valve NV is lifted by a fuel pressure to open the nozzle N as well as to create a swirl flow of fuel, or a spiral form, thereby continuously producing a fuel film of a conical shape.

As shown in FIG. 14, the ultrasonic wave generating means 1021 comprises a piezoelectric ultrasonic transducer 1025 having piezoelectric elements 1024 of PZT which are sandwiched between a backing block 1023 and a mechanical vibration amplifying portion 1022 by means of four bolts; a mechanical vibration amplifying portion 1022 made of a stepped type horn which is integrally secured to the ultrasonic wave transducer 1025 by means of bolts; and an ultrasonic vibratory member 1020 of a hollow cylindrical shape, which is integrally formed on an output end portion of the mechanical vibration amplifying portion 1022, with the respective axes being directed perpendicularly of each other.

The ultrasonic wave transducer 1025 transforms by means of a pair of PZTs into mechanical vibrations the electric oscillation from an ultrasonic wave oscillator 1026 adapted to start a given electric ultrasonic oscillation, when an engine switch IK is turned on.

A flange portion having a large cross sectional area in the mechanical vibration amplifying portion 1022 is secured through the medium of a flange of the backing block 1023 to a side wall of the air supply passage 1001, by means of the aforenoted bolt means, thereby holding the entire ultrasonic wave generated means. The ultrasonic vibratory member 1020 of a hollow cylindrical shape is positioned upstream of a collecting portion PCP of an intake manifold PO but somewhat downstream of the injector 1601 in the center of the air supply passage 1001 in coaxial relation thereto.

Figure 17:
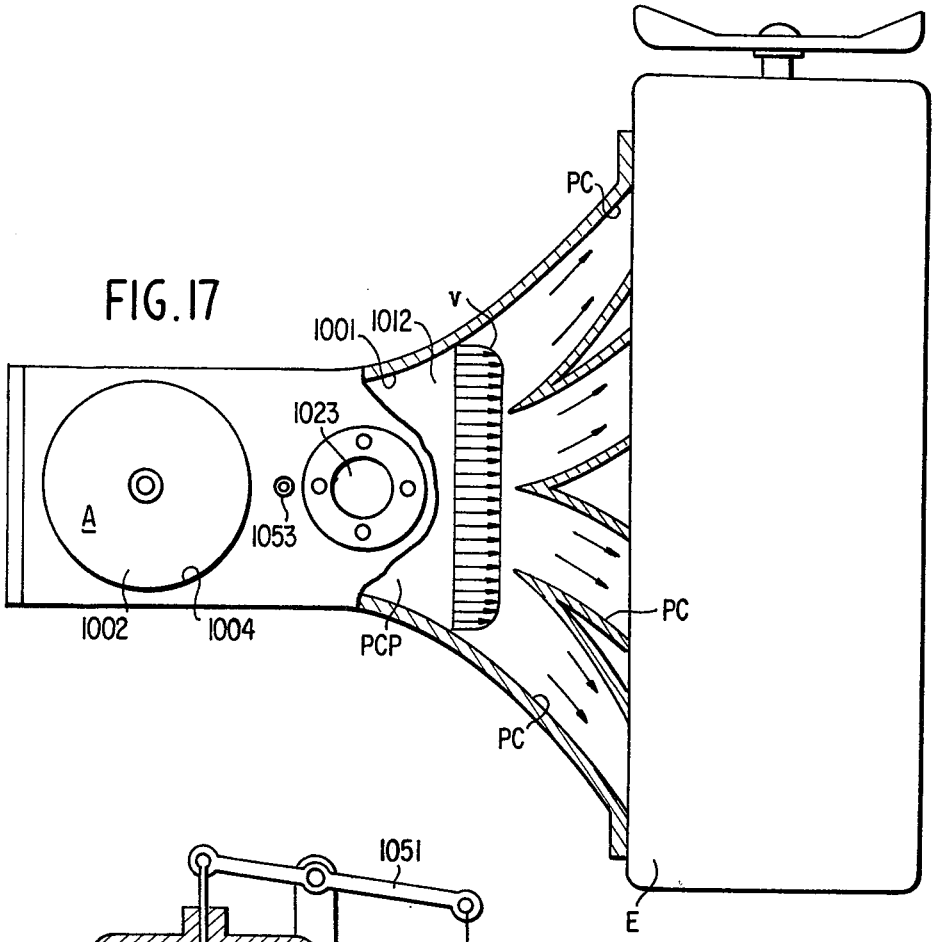

Meanwhile, according to this embodiment, the air supply passage 1001 and air intake manifold PC, as shown in FIG. 17, are so designed as to minimize the number of bends so as to prevent the clinging of atomized fuel to the walls of the bends. In addition, the air supply opening of the throat 1006 is of a variable rectangular shape, so that atomized fuel and air may be mixed with each other thoroughly, with the speed distribution being as shown by a symbol V. This is accomplished with the aid of the provision of the intake manifold PC having a suitable mixing space 1112 downstream of the ultrasonic vibratory member 1020.

Furthermore, according to this embodiment, an engine is started by means of an ignition key IK connected to a battery BT. However, this embodiment further includes a relay means (not shown) which insures positive driving of a predetermined sequence of turning the ignition key on, driving the ultrasonic wave oscillator 1026, driving the pump 1041, and driving an engine starter.

Figure 18:
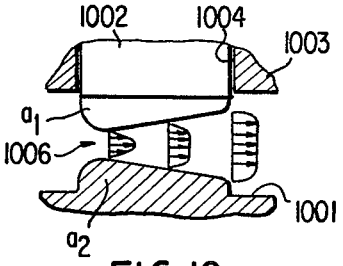

With the fuel supply system of the aforenoted arrangement, the intake air control means A introduces air streams, as shown in FIG. 18, which form stable, smooth and parallel stream lines along the length of the air supply passage, with the freedom of disorder. Furthermore, fuel is injected through the nozzle N in the fuel injector 1601 in a given amount in the form of a conical liquid film continuously in a manner that the liquid film supplied over the entire inner peripheral surface of the ultrasonic vibratory member 1020 in the ultrasonic wave generating means 1021 may be atomized into extremely fine liquid droplets due to the ultrasonic vibrations, after which the liquid droplets are thoroughly mixed with air thus introduced, and then the mixture is supplied through the section port SPT via an intake valve IV to respective cylinders C of an engine E, for complete combustion of a mixture charge.

More particularly, the fuel supply system according to the third embodiment includes the intake air control means A, in which the movable member $a_1$ is positioned in the air supply passage 1001, with the axes of the member $a_1$ and the passage 1001 being peripendicular to each other, whereby the movable member $a_1$ may reciprocate so as to control the opening and closing of the air supply passage 1001. As a result, the streams of intake air may be so arranged within the air supply pressure 1001 as to provide smooth parallel air streams along the length of the air supply passage 1001, and then the flow rate of the intake air may be controlled with high accuracy, so that the air may be thoroughly mixed with extremely fine atomized fuel droplets created by the ultrasonic vibratory member 1020 of a hollow cylindrical shape. In addition, the atomized fuel may be prevented from clinging to the inner surfaces of the wall of the atomized fuel supply passage 1001, thereby enhancing the flow of a mixture charge in an attempt to improve responsiveness in supplying the mixture to meet the running condition of an engine. As a result, the mixture charge thus supplied may be completely burned and the production of harmful constituents of exhaust gases may be suppressed, with an accompanying improvement in fuel consumption.

As is apparent from the foregoing description, according to this embodiment as in the previous embodiments, the fuel is entirely supplied through the fuel injector 1601 in the form of thin film to an ultrasonic vibratory member 1020 of a hollow cylindrical shape, so that there may be created finely atomized fuel over the wide running range of an engine, and thus substantially the entire amount of fuel supplied is completely atomized. This advantage has no comparison with that of a prior art carburetor and fuel injector suffering from the fuel clinging to the inner surfaces of an air supply passage or a suction port. Furthermore, the atomizing rate and the atomized amount of fuel are excellent, as compared with those of the prior art system, in which fuel is supplied to a specific spot or spots.

Furthermore, the fuel supply system according to this embodiment is positioned downstream of the intake air control means A in the air supply passage, so that the fuel atomized by the ultrasonic vibratory member 1020 by no means clings to a throttle vale or the like as in the conventional systems, nor to the wall of the air supply passage, with the result that the fuel thus atomized may be supplied in its entire amount to a combustion chamber F.

Meanwhile, the means by which the fuel of a liquid film form is supplied to the ultrasonic vibratory member of a hollow cylindrical shape should not necessarily be limited to this instance, but means as shown in FIGS. 3 to 8 may be employed alternatively.

Figure 19:
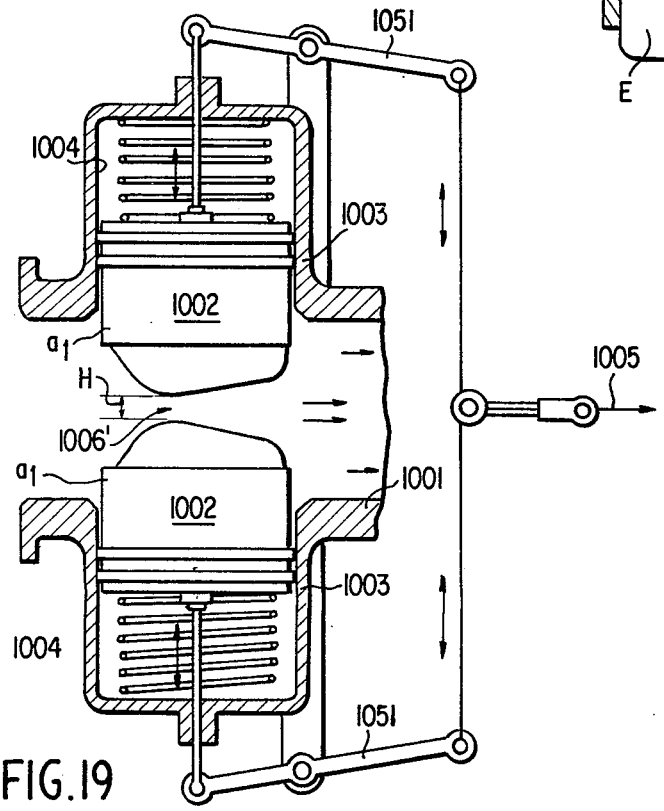
FIG. 19 is a view, partly in section, illustrative of a modification of the intake air control means.

Still furthermore, the intake air control means A according to the third embodiment should not necessarily be limited to this instance, but as shown in FIG. 19, mutually opposed movable members $a_1$ may be positioned in the air supply passage 1001, with the respective axes of the members being perpendicular to the axis of the air supply passage 1001, whereby the axis of an opening of the throat 1006 may be brought into alignment with the center axis of the ultrasonic vibratory member 1020 of a hollow cylindrical shape. Still alternatively, there may be provided an intake air control means of a variable throttle mechanism allowing the change in shape of the opening into a cylindrical or an elliptic shape, the aforenoted opening being adapted to introduce intake air in the form of parallel air streams, thereby achieving advantages which are equivalent to those of the aforenoted embodiment.

Description is now made of the fourth to sixth embodiments according to the present invention (the third aspect) in which the present invention is applied as a fuel supply system for use in an automotive gasoline engine, a sort of Otto cycle engine.

Heretofore, the fuel supply systems of Otto cycle engines have aimed at the atomization of the fuel by itself, attempting to remove the liquid film flows of the fuel along the intake pipe by heating the intake pipe by utilizing the exhaust gas heat. In contrast thereto, these embodiments provide the fuel supply system which performs only the function of supplying and regulating the fuel, and not the function of atomization of the fuel in any way whatsoever. More particularly, the fuel is positively turned into a liquid film by a wall member which is provided downstream of a throttle valve and the liquid film flow of the fuel is completely atomized by a ring type ultrasonic vibratory member which is positioned immediately downstream of the wall member to supply a mixture charge to the respective cylinders, with the atomized fuel being carried on air streams. The atomized fuel is immediately mixed with the air and swiftly delivered to the cylinders without reclinging to the inner surfaces of the intake pipe, so that the response to a variation in the operating conditions of the engine may be improved and the cylinders are supplied with a proper air-fuel mixture charge all the times. This ensures that optimum combustion be effected in all operating conditions of the engine and contributes to the improvement of fuel consumption, reduction in the amount of harmful gases and better driveability. In addition, the fuel supply system which is directed only to the formation of a fuel film is simple in construction and can control the flow rate of the fuel more readily, thus enabling desired control of the air-fuel ratio over a wide operating range of the engine.

Figure 20:
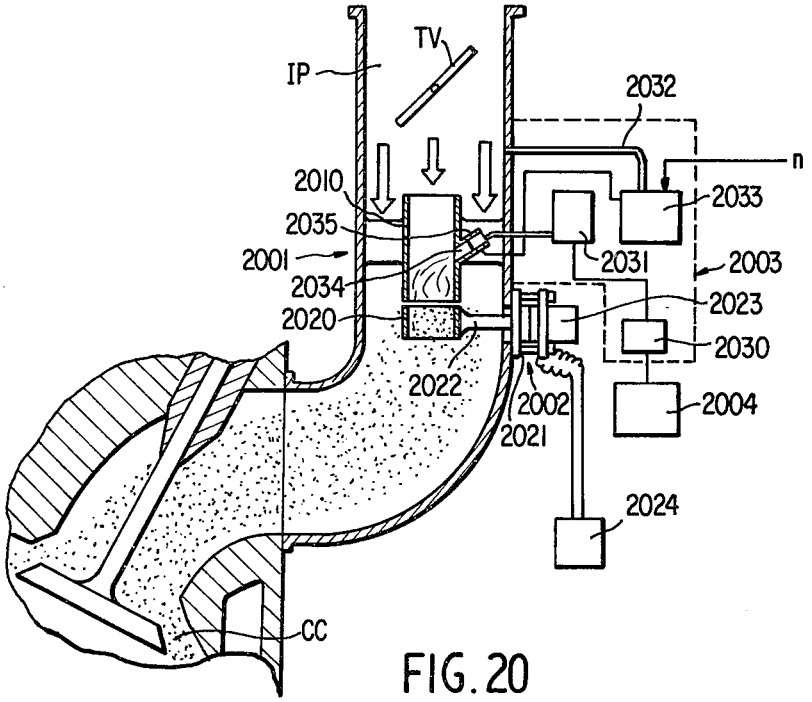
FIG. 20 is a sectional view showing the fuel supply system of a fourth embodiment of the present invention.

Referring to FIG. 20, there is shown the fourth embodiment of the fuel supply system using an ultrasonic vibratory member in the form of a hollow cylinder, which is used as a fuel supply system for use in an automotive internal combustion engine.

The fuel supply system of the fourth embodiment has a wall member 2001 of a hollow cylindrical shape which is coaxially positioned within an intake air pipe IP of a gasoline engine and an ultrasonic vibratory member of a hollow cylindrical shape which is positioned immediately downstream of and coaxially with the wall member 2001.

The fuel supply system of the fourth embodiment includes: a fuel tank 2004 which is located in a rear portion of a motor vehicle; a pressurizing and regulating means 2003 which pressurizes the fuel from the fuel tank to a given pressure level and supplies the fuel at a regulated flow rate through a nozzle to a wall member which will be described hereinlater; a wall member 2001 provided in and coaxially with an intake air passage IP at a position downstream of the throttle valve TV for forming a liquid film of the fuel which is supplied through the nozzle; and an ultrasonic wave generator 2002 which is located downstream of and closely proximate to the wall members 2001.

The pressurizing and regulating means 2003 includes a pump 2030 which is driven by a motor and communicates with the fuel tank 2040; a pressure regulating valve 2031 which communicates with an output port of the pump 2030 for regulating the pressurized fuel from the pump 2030 to a given pressure level; a computer 2033 which is adapted to give fuel flow rate control signals by calculation based on a negative pressure prevailing in the intake air pipe, which is introduced through a bypass passage 2032, and the engine speed (n); and a solenoid 2035 which controls an open area of a needle valve of the fuel injector 2034 according to the signals from the computer 2033.

The wall member 2001 has a hollow cylinder 2010 which is held in the coaxial position in the intake air passage IP by four radially extending rectangular members which are provided at an angular spacing of 90° around the circumference of the hollow cylinder 2010. The hollow cylinder 2010 is provided with a throughhole for receiving a tangential and downwardly inclined injection nozzle 2034 which opens at the inner peripheral wall thereof. Thus, the wall member 2001 is coaxially positioned within the intake air passage IP to form an auxiliary air body.

The ultrasonic wave generator 2002 includes, as shown in FIG. 20, a piezoelectric type ultrasonic transducer 2021 having piezoelectric elements of PZT, connected to an ultrasonic oscillator 2024 which produces ultrasonic electric oscillations, the aforenoted piezoelectric elements being interposed between a backing block 2023 and a mechanical vibration amplifier 2022 by means of four bolt means, and the mechanical vibration amplifier 2022 having a stepped type horn which is secured to the ultrasonic transducer 2021 by the aforenoted bolt means, and an ultrasonic vibratory member 2020 of a hollow cylindrical shape which is formed integrally with an output end of the mechanical vibration amplifier 2022 in such a manner that the respective axes are disposed perpendicularly to each other.

The ultrasonic vibratory member 2020 of a hollow cylindrical shape has an inner diameter substantially the same as that of the wall members 2001 and is located coaxially within the intake air passage IP at a position proximal to the wall member 2001.

With the fuel supply system of the fourth embodiment arranged in this manner, the computer 2033 of the pressurizing and regulating device 2003 energizes the solenoid 2035 according to the negative pressure level in the intake air pipe which is introduced through the bypass passage 2032 and the engine speed (n), to control an open area of the needle valve of the injector 2034, thereby supplying fuel to the inner peripheral surface of the wall member 2001 through the inwardly inclined nozzle of the injector 2034 at a flow rate suitable for operating conditions of the engine. The fuel supplied to the inner peripheral surface of the wall member 2001 flows down helically, forming a thin liquid film over the entire inner surface of the wall member 2001 and falls onto the inner peripheral surface of the contiguously located hollow cylindrical body of the ultrasonic vibratory member which undergoes ultrasonic vibrations, whereupon the liquid film of the fuel is atomized into extremely fine droplets and mixed with air introduced into the intake air passage IP. The air-fuel mixture is supplied through a branched passage and an intake port into a combustion chamber CC where the sufficiently atomized fuel undergoes complete combustion.

As is clear from the foregoing, the fourth embodiment provides an advantage in that the entire amount of fuel supplied is formed into a thin film, before reaching the cylindrical vibratory member 2020, so that the fuel is invariably atomized into extremely fine droplets to effect complete atomization of the fuel over a wide operating range of the engine. This precludes the drawback of the conventional carburetors and fuel injectors which fail to atomize the fuel into sufficiently fine droplets of uniform size.

In the fourth embodiment, air is allowed to flow on the inner and outer sides of the wall member 2001 without disturbing the air streams, and the fuel which has been atomized by the ultrasonic vibratory member 2020 is thoroughly mixed with air which flows on the inner and outer sides of the vibratory member 2020, thus supplying a desired air-fuel mixture to a combustion chamber CC.

The fourth embodiment has the ultrasonic vibratory member 2020 located in the intake air passage IP at a position downstream of the throttle valve TC, so that there is no possibility of the atomized fuel clinging to the throttle valve, namely, substantially the entire amount of the fuel is supplied without being left on the throttle valve, intake passage or other walls.

The fourth embodiment has another advantage in that the ultrasonic vibratory member has a hollow cylindrical body of a large surface area and therefore is capable of atomizing a large amount of fuel.

Furthermore, in the fourth embodiment, the liquid film of the fuel is atomized by the ring type ultrasonic vibratory member 2020. Between the wall member 2001 which constitutes an auxiliary air body and the intake air passage IP, air flows at a higher speed than through the auxiliary air body and wraps a mixture of air and atomized fuel while flowing into the combustion chamber CC through the intake air passage IP. The atomized fuel is thus completely mixed with air before the end of the intake and compression strokes of the engine. Therefore, the atomized fuel is prevented from clinging to the walls of the intake pipe and gives a sharp response to a variation in the operating conditions. The fuel which bleeds out through a gap between the auxiliary air cylinder and the ring type ultrasonic vibratory member is also atomized on the outer peripheral surface of the vibratory member, thus attaining complete atomization of the liquid films of the fuel. This embodiment is adapted to control the fuel flow on the basis of the signals representing a negative pressure prevailing in the intake air pipe and engine speed, which however may be added or replaced by signals representing an output of an air-mass-flow-rate meter, an output of a lambda sensor, a venturi vacuum or an accelerator pedal displacement, etc. if desired. The accelerator pedal displacement is raised herein as a substitute for an acceleration pump of the conventional carburetor. With lean combustion engines which have a relatively large throttle opening (low intake-air-pipe-pressure), the fuel flow may be controlled solely on the basis of an engine-speed signal. This system can be designed to give surviving stratification effects of fuel and air by ignition by a spark plug.

Figure 21:
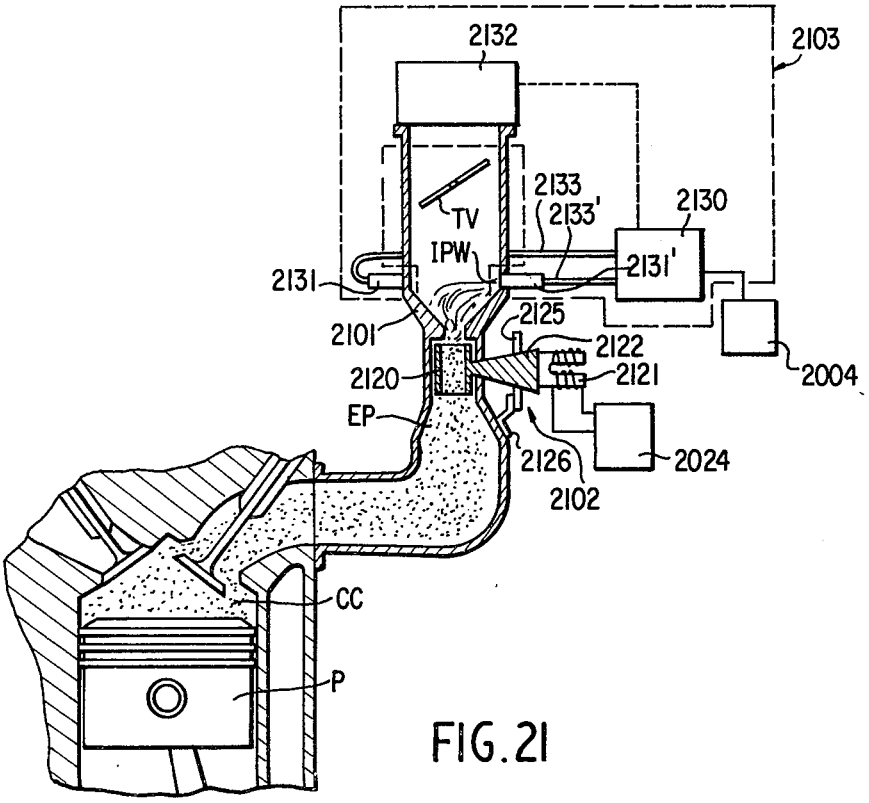
FIG. 21 is a sectional view showing the fuel supply system of a fifth embodiment of the present invention.

Referring now to FIG. 21, there is shown a fifth embodiment of the fuel supply system employing an ultrasonic vibratory member of a hollow cylindrically shaped body according to the invention, which is applied to an automotive internal combustion engine, similarly to the previous embodiments.

The fuel supply system of the fifth embodiment has a wall member defined by the wall of the intake air passage and is different from the fourth embodiment in that the inner diameter of the wall member is gradually reduced; the fuel is injected tangentially to the top of the wall member at two diametrically opposed spots; and the ultrasonic wave generator has a magnetostrictive ultrasonic transducer. The following description is principally directed to these different points and like parts are designated by like reference numerals without detailed description.

The fuel supply system of the fifth embodiment includes a fuel tank 2004 which is located in the rear portion of a motor vehicle, a pressurizing and regulating device 2103 which pressurizes the fuel from the fuel tank 2004 and supplies the same onto the inner peripheral surface of a wall member 2101 through nozzle means at a flow rate regulated in accordance with the amount of the intake air, a wall member 2101 which is provided in an intake air passage IP in coaxial relation thereto but at a position downstream of a throttle valve TC, and an ultrasonic wave generator 2102 which is located in a cavity immediately downstream of the wall member 2101.

The pressurizing and regulating device 2103 includes a fuel pump 2130, the rotational speed of which is controlled by electric signals indicative of the amount of intake air which is produced by an air-mass flow meter positioned in the intake air passage IP downstream of the throttle valve TC to thereby feed the fuel in accordance with the amount of intake air, and two fuel injectors 2131 and 2131' which inject the fuel tangentially to the inner peripheral wall of the wall member 2101 through pipes 2133 and 2133', respectively, which open at two diametrically opposed points on the larger-diameter top end of the wall member 2101. The pump 2130 discharges fuel of a constant amount under a constant pressure per rotation, so that the amount of fuel injected can be varied solely by controlling the rotational speed of the pump 2130.

The wall member 2102 is defined by a gradually reduced inner diameter of the wall IPW of the intake air passage into a funnel shape, providing tangential bores in the inner peripheral wall at two diametrically opposed spots for mounting two fuel injectors 2131 and 2131', respectively, of the aforenoted pressurizing and regulating device.

The ultrasonic wave generator 2102 includes a U-shaped magnetostrictive ultrasonic transducer 2121 connected to an ultrasonic oscillator which produces ultrasonic electric oscillations, a Fourier type mechanical vibration amplifier 2122 integrally secured to the transducer 2121, and an ultrasonic vibratory member 2120 of a hollow cylindrically shaped body which is formed integrally at the output end of the mechanical vibration amplifier 2122. An annular member 2125 is provided at the nodal point of ultrasonic vibration of the mechanical vibration amplifier 2122, and secured to one end of support member 2126 of S-shape in longitudinal cross section. The outer end of the support member 2126 is secured, by bolt means, to the outer peripheral wall of the intake air passage. The ultrasonic vibratory member 2120 of a hollow cylindrical body is positioned in the cavity downstream of and coaxially with the constricted outlet end of the wall member 2101 which is formed integrally with the wall IPW of the intake air passage. The ultrasonic vibratory member 2120 has an inner diameter substantially the same as that of the outlet end of the wall member 2101. The ultrasonic wave generator receives electric signals of predetermined frequency from the ultrasonic oscillator 2024 and converts the same into mechanical vibrations by the ultrasonic transducer 2121. The mechanical vibrations are amplified by the mechanical vibration amplifier 2122 to put the ultrasonic vibratory member 2120 of hollow cylindrical shape in petal-like flexural vibration.

The inner diameter of the intake air passage donwstream of the ultrasonic vibratory member of a hollow cylindrical body is gradually increased to prevent the clinging of the atomized fuel thereto.

In the fuel supply system of the fifth embodiment described above, the fuel pump 2130 supplies pressurized fuel at a controlled flow rate to the fuel injectors 2131 and 2131' according to the output signals of the air-mass flow-rate meter 2132 which is located upstream of the throttle valve TV. The injectors 2131 and 2131' inject the fuel in a horizontal direction along the inner periphery of the top end of the wall member 2101. The fuel which has been injected horizontally along the inner periphery of the wall member 2101 is formed into a thin liquid film spread over the entire inner peripheral surface, while swirling and flowing down toward the ring type ultrasonic vibratory member 2120, where the liquid film is atomized by the ultrasonic wave energy which is applied by the flexural vibrations of the ultrasonic vibratory member 2120. The atomized fuel is thoroughly mixed with air and carried on the air streams in the intake air pipe IP and reaches the combustion chamber CC for complete combustion. The intake air pipe IP is provided with an enlarged portion EP to prevent the clinging of the fuel thereto which has been atomized by the vibratory member 2120. The fifth embodiment has the wall member 2101 with a gradually constricted inner peripheral surface, so that it is further advantageous, as compared with the fourth embodiment in that the air flows are given higher speed and greater energy which affords a pressing force to the fuel flowing along the inner periphery of the wall member, thereby improving creation of liquid films.

The injection pump provides a constant discharge rate and pressure per rotation so that the control of the flow rate of the injecting fuel can be effected solely in terms of the rotational speed of the pump.

Similarly to the fourth embodiment, the fuel is supplied along the wall member 2101 in the fifth embodiment without disturbing the air flows, so that there can be constantly formed a liquid film of fuel, which is optimum for the atomization of the ring type ultrasonic vibratory member under any operating condition of an engine. In addition, the funnel shaped wall member forms a restricted portion in the intake air passage, which contributes to attenuate the pulsation of intake air which causes blow-back flow of the fuel supplied. In addition, it is also useful for enhancing the response of air streams to a variation in operating conditions of an engine. To enhance more positive creation of liquid films, the air streams may be afforded swirling motions, or the wall member may be provided with a helical groove in the inner peripheral surface of the intake air pipe at a position downstream of the fuel injection ports and contiguously to the ring type ultrasonic vibratory member.

In other respects, the fifth embodiment has the same effects as the abovedescribed first embodiment.

Figure 22:
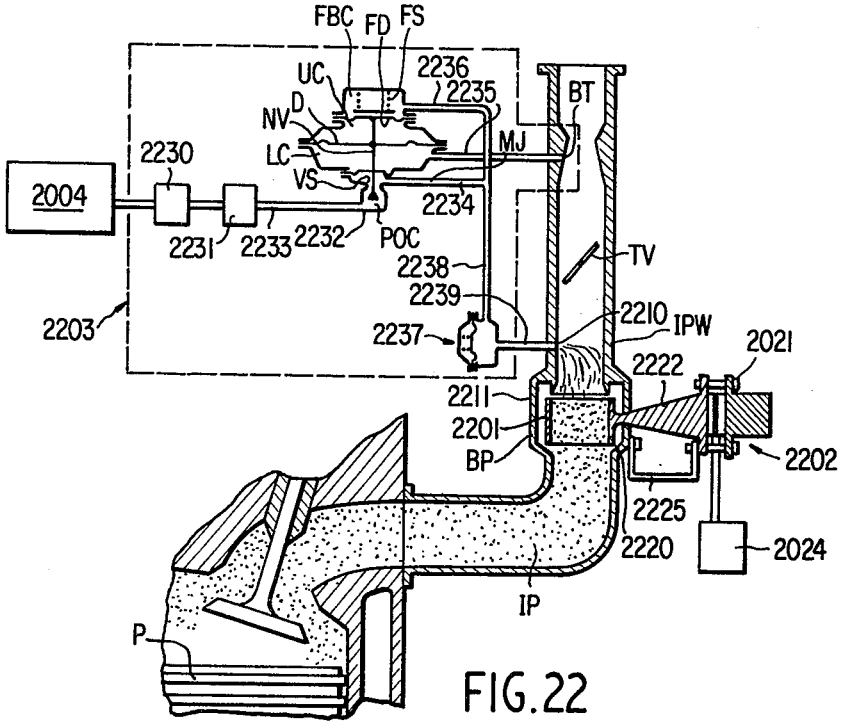
FIG. 22 is a sectional view showing the fuel supply system of a sixth embodiment of the present invention.

FIG. 22 shows a sixth embodiment of the fuel supply system employing an ultrasonic vibratory member of a hollow cylindrical body according to the invention, which is likewise applied to an automotive internal combustion engine.

The fuel supply system of the sixth embodiment is different from the fourth and fifth embodiments in that a wall member 2201 is constituted by an intake air passage portion of a uniform inner diameter and has a projection with a downwardly decreasing wall thickness; a pressurizing and regulating device 2203 is constituted by an injection carburetor; the ultrasonic wave generator 2202 has a mechanical vibration amplifier 2222 of catenary horn type and an ultrasonic vibratory member 2220 of a hollow cylindrical body is located in a large-diameter portion or bulged portion BP of the intake air passage IP immediately downstream of the wall member 2201.

The wall member 2201 is constituted by an intake passage wall portion IPW downstream of the throttle valve TV which portion has a uniform inner diameter along the length thereof, the member 2201 having a projection 2211, the inner diameter of which is downwardly enlarged to have a downwardly reduced wall thickness and an opening 2210 which is provided immediately upstream of the wall member to supply the fuel thereto.

The pressurizing and regulating device 2203 is constituted by an injection carburetor, in which a passage 2235 which opens into a venturi portion BT in the intake air passage is communicated with a venturi vacuum supply chamber or lower chamber LC of a diaphragm device, the upper chamber UC of which communicates with the atmosphere. The fuel in the fuel tank 2004 is fed from a fuel pump 2230 to a fuel pressure control device 2232 and a fuel pressure regulating chamber PCC through a filter 2231 and a passage 2233. The fuel pressure control chamber PCC is provided with a valve including a needle valve NV which is connected to the diaphragm D and to the feedback chamber diaphragm FD and an opposingly disposed valve seat VS. A distance between the needle valve NV and the valve seat VS is controlled according to a venturi vacuum level to control the pressure of the fuel which is supplied to a discharge pressure control device 2237 via main jet MJ and passage 2234 and 2238. To the opening 2210 of the wall member 2201 which serves as a nozzle, the discharge pressure control valve 2237 supplies through passage 2239 a fuel, whose pressure has been regulated to a predetermined pressure level. The passage 2234 communicates through a passage 2236 with feedback chamber FBC which has a tension spring FS, to supply to the feedback chamber FBC a part of the fuel in the fuel pressure regulating chamber PCC by the movement of a diaphragm FD in response to the movement of the needle valve NV, thereby preventing the discharge pressure control valve 2237 from supplying the fuel in an excessive amount to the wall member 2201 when an abrupt pressure variation takes place within the intake air passage.

The ultrasonic wave generator 2202 employs a mechanical vibration amplifier of catenary type ultrasonic horn 2222 which is integrally secured, by bolts, to a piezoelectric type ultrasonic transducer 2021 which in turn is connected to an ultrasonic oscillator 2024 as in the fourth embodiment, the horn having an ultrasonic vibratory member 2220 of hollow cylindrical shape integrally formed at the distal end thereof. The flange which is formed at the base end of the catenary type ultrasonic horn 2222 is secured, by bolts, to a backing block of the above-mentioned transducer 2021, along with one of a U-shaped support member 2225, the other end of which is secured, by bolts, to the outer peripheral surface of the intake passage, thereby holding the ultrasonic vibratory member 2220 within the bulged portion BP downstream of the wall member 2201 in coaxial relation thereto. In this instance, the inner periphery of the ultrasonic vibratory member 2220 is held in contacting alignment with the outer periphery of the projection of the wall member 2201.

With the fuel supply device of the sixth embodiment described above, the pressurizing and regulating device 2203 detects the operating condition of an engine by way of a vacuum level in the intake air passage and supplies the fuel to and over the inner peripheral surface of the wall member 2201 through its opening 2210. The liquid film of fuel which has reached the projection 2211 is supplied in its entirety to the contiguously located ultrasonic vibratory member 2220 and completely atomized by the ultrasonic vibration of the vibratory member 2220. The atomized fuel is thoroughly mixed with air which has been passed through the center of the ultrasonic vibratory member 2220 and supplied to the combustion chamber CC for complete combustion therein.

Especially, the sixth embodiment has an advantage in that the entire amount of the supplied fuel is fed to the ultrasonic vibratory member 2220 from the projection 2211 of the wall member 2201, namely, the supplied fuel is entirely fed to the combustion chamber CC.

In other respects, the sixth embodiment has the same effects as the fourth and fifth embodiments.

The present invention has been described by way of embodiments which are applied as a fuel supply system for use in an automotive internal combustion engine, but it is not limited to the particular embodiments shown. The invention can be applied as a fuel supply system for many different combustion devices or other apparatus which require a mixture of atomized fuel and air.

The ultrasonic wave generators of the foregoing embodiments employ stepped type horns, Fourier type horns and catenary type horns, respectively, as a mechanical vibration amplifier for driving the ultrasonic vibratory member of a hollow cylindrical body. However, there may be employed other ultrasonic wave horns including the exponential type horn. In addition, the manner of engagement between the hollow cylindrical body of the ultrasonic vibratory member and the mechanical vibration amplifier and their shapes and constructions can be modified into various forms different from the foregoing embodiments.

The fuel injector and wall member which forms a liquid film of fuel also allows various modifications and variations.

The pressurizing and regulating device can employ flow control and pressurizing means other than those shown in the foregoing embodiments, as long as it can supply the fuel in accordance with the requirements of an internal combustion engine and a combustion device.

Figure 23:
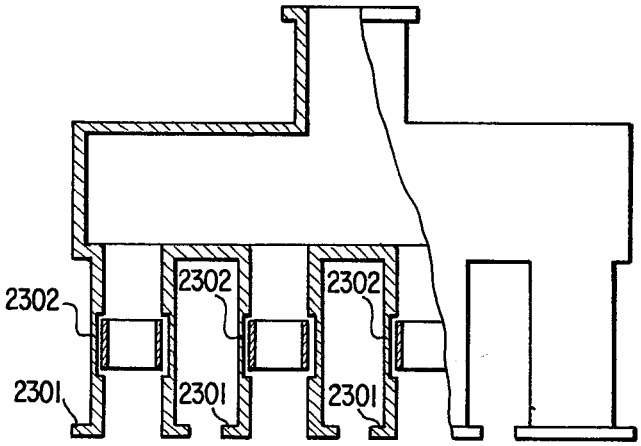
FIG. 23 is a fragmentary sectional view showing a modification of the fourth to sixth embodiments.

In the fourth to sixth embodiments, the wall member and ultrasonic vibratory member are located in the intake air passage upstream of a point where the intake air passage is branched so as to communicate with the respective cylinders. However, a wall member and an ultrasonic vibratory member may be provided in each one of the branched intake air passages as shown in FIG. 23. In this instance, it becomes possible to preclude the troubles resulting from failure of uniform distribution of the air-fuel mixture.

Figure 24A:
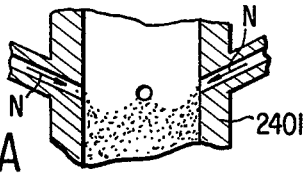
FIGS. 24 and 25 are views showing modified forms of the nozzle in the pressurizing and regulating means of the present invention.
Figure 24B:
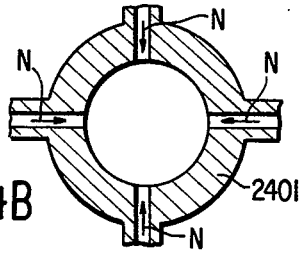

FIG. 24 illustrates a system which is provided with one or a number of injection ports instead of the injectors in the fourth to sixth embodiments, each one of the injection ports having a needle for controlling the flow rate of the pressurized fuel which is delivered from a pump (not shown).

Figure 25A:
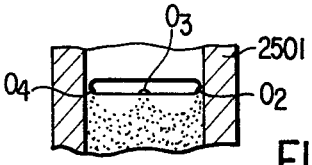
Figure 25B:
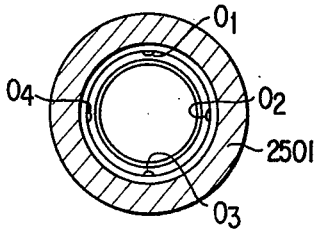

As shown in FIG. 25, the pressurizing and regulating device in the fourth to sixth embodiments may be provided with a nozzle in the form of a hollow ring which is located coaxially on the inner side of the wall member and provided with injection ports $0_1$ to $0_4$ for injecting the fuel to the inner peripheral surface of the wall member. In this instance, the direction of the fuel injection should be selected such that the fuel will be formed into a liquid film, without being splashed by the inner peripheral wall surfaces. In addition, the ring should be of a large inner diameter which would not disturb the streams of air flowing therethrough.

While the present invention has been described herein with reference to certain exemplary embodiments thereof, it should be understood that various changes, modifications, and alterations may be effected without departing from the spirit and scope of the present invention, as defined in the appended claims.

What is claimed as new and desired to be secured by Letters Patent of the United States is:

1. A fuel supply system employing an ultrasonic vibratory member of a hollow cylindrically shaped body comprising:

an intake passage having an intake air control means for controlling the flow rate of the intake air, through which air is fed;

a fuel tank for storing fuel therein;

a pressurizing and regulating means for pressurizing the fuel supplied from said fuel tank to a predetermined pressure level, and regulating the flow rate of said fuel;

an ultrasonic wave generating means comprising an ultrasonic wave transducer connected to an ultrasonic wave oscillator for transforming an electric oscillation into mechanical vibrations, a mechanical vibration amplifying portion which is integrally secured to said ultrasonic wave transducer, and an ultrasonic vibratory member of a hollow cylindrically shaped body having a predetermined length and diameter, which is integrally secured to an output end of said mechanical vibration amplifying portion, with the axis of said member being directed perpendicularly to the axis of said mechanical vibration amplifying portion, and which is provided within said air supply passage; and liquid film forming and supplying means, connected to said pressurizing and regulating means, having an exit provided at the position adjacent to said ultrasonic vibratory member of said hollow cylindrically shaped body, said liquid film forming and supply means being specifically designed for forming a thin film of said supplied fuel and supplying said fuel film from said exit to said ultrasonic vibratory member of said hollow cylindrically shaped body, whereby film like fuel is atomized by said ultrasonic vibratory member of said hollow cylindrically shaped body, and the mixture of fine droplets of said fuel and the air is supplied through said intake passage.

2. A fuel supply system according to claim 1, wherein:

said liquid film forming and supplying means comprises an injector connected to said pressurizing and regulating means and having an exit in the close vicinity of a center axis of said ultrasonic vibratory member of a hollow cylindrically shaped body in said ultrasonic wave generating means, whereby fuel is injected through said exit of said injector onto at least one of the inner and outer peripheral surfaces of said ultrasonic vibratory member of a hollow cylindrically shaped body in the form of a divergently spread liquid film.

3. A fuel supply system according to claim 1, wherein:

said intake air control means has at least one movable member placed in said intake passage in a manner that the axis of said movable member is directed at a right angle to the axis of said intake passage, said movable member being reciprocable in order to control the opening area of said intake passage, whereby the smooth flow of said intake air is produced, in the form of parallel air streams running in the axial direction of said intake passage, within said intake passage, and the attachment of said droplets of said fuel is prevented.

4. A fuel supply system according to claim 1, wherein said liquid film forming and supplying means comprises:

a wall member having a peripheral wall surface of a predetermined length and substantially the same diameter as that of at least either the inner or outer periphery of said hollow cylindrically shaped body of said ultrasonic vibratory member at an end of said wall member which is disposed adjacently to and coaxially with said hollow cylindrically shaped body of said ultrasonic vibratory member; and nozzle means inserted within said wall member and connected to said pressurizing and regulating means, said nozzle means being opened tangentially of said peripheral wall surface of said wall member, whereby said regulated fuel is supplied to said peripheral wall surface of said wall member through said nozzle means; said supplied fuel stably flows down in the form of a thin film along said peripheral wall surface; said fuel in the form of a thin film is atomized in a stable manner into extremely small droplets of said fuel by said ultrasonic vibratory member; and said extremely small droplets of said fuel are sufficiently mixed with air flowing through said wall member and said ultrasonic vibratory member.

5. A fuel supply system according to claim 2, wherein: said injector forms a continuous fuel film.

6. A fuel supply system according to claim 2, wherein said injector forms divided fuel films.

7. A fuel supply system according to claim 2, wherein said injector continuously supplies fuel film.

8. A fuel supply system according to claim 2, wherein said injector intermittently supplies fuel film.

9. A fuel supply system according to claim 5, wherein said injector comprises a swirl type injector in which a spiral groove is provided at an outer peripheral wall of a needle valve inserted within a hollow cylindrical nozzle body having a nozzle port, so as to supply a swirl of a cone-shaped fuel film, i.e. a liquid film in the form of a diverging spray of fuel from said nozzle port.

10. A fuel supply system according to claim 5, wherein said injector comprises a swirl type injector which comprises a cylindrical vortex chamber connected to a nozzle port provided at a hollow cylindrical nozzle body, and at least one opening is provided in a wall of said vortex chamber in the tangential direction thereof so as to tangentially inject fuel within said vortex chamber through said opening and to supply a liquid film in the form of a diverging spray of fuel from said nozzle port.

11. A fuel supply system according to claim 5, wherein said injector comprises an impingement type injector which comprises a hollow cylindrical nozzle body having a nozzle port, and a needle valve having a T shape longitudinal section, a leg portion of said needle valve being inserted within said nozzle port, whereby fuel is injected at high speed toward a top surface of said needle valve through a clearance around said leg portion of said needle valve, and diverging spray of a dish-shaped fuel film is supplied from said top surface of said needle valve.

12. A fuel supply system according to claim 6, wherein said injector comprises a swirl type injector which comprises a cylindrical vortex chamber connected to a nozzle port provided at a hollow cylindrical nozzle body, at least one opening provided in a wall of said vortex chamber in the tangential direction thereof, and cross grooves having a V shape cross section provided at the lower surface of said nozzle body, a cross point of said cross grooves coinciding with said nozzle port, thereby to supply four divided fuel films from said cross grooves.

13. A fuel supply system according to claim 6, wherein said injector comprises an impingement type injector which comprises a hollow cylindrical nozzle body having a nozzle port, a needle valve having a T shape longitudinal section, a leg portion of said needle valve being inserted within said nozzle port, and four axial grooves provided along an outer peripheral wall from said leg portion to a top portion of said needle valve, thereby to supply four divided fuel films from said four axial grooves.

14. A fuel supply system according to claim 2, further comprising a cover member comprising a bottomed hollow cylindrical member having a streamline longitudinal section, coaxially provided in said intake passage, and wherein said injector is coaxially interposed within said cover member, and said ultrasonic vibratory member of said hollow cylindrically shaped body is provided in said intake passage in a manner that an upper portion thereof is positioned nearer to an opening portion of said cover member, whereby the fuel film supplied from said injector is not disturbed by the air flow in said intake passage.

15. A fuel supply system according to claim 2, wherein said intake passage has a concave portion, said injector and said ultrasonic vibratory member of said hollow cylindrically shaped body are interposed in series within said concave portion, an output end of said ultrasonic vibratory member being faced to said intake passage, whereby the fuel film supplied from said injector is not disturbed by the air flow in said intake passage.

16. A fuel supply system according to claim 1, wherein said ultrasonic vibratory member of said hollow cylindrically shaped body in said ultrasonic wave generating means has a plurality of holes penetrating from an inner wall to an outer wall thereof, whereby the fuel supplied to one wall of said ultrasonic vibratory member may be atomized on both walls of said ultrasonic vibratory member by connecting said inner and outer walls through said plurality of holes.

17. A fuel supply system according to claim 1, wherein said ultrasonic wave transducer of said ultrasonic wave generating means comprises one selected from the group consisting of an ultrasonic wave transducer having piezoelectric elements and an ultrasonic wave transducer having a magnetostrictive element.

18. A fuel supply system according to claim 1, wherein said mechanical vibration amplifying portion in said ultrasonic wave generating means comprises one selected from the group consisting of a stepped type horn, a Fourier type horn, a catenary type horn, an exponential type horn and a conical type horn.

19. A fuel supply system according to claim 4, wherein said wall member comprises a hollow cylinder having an inner diameter substantially coinciding with an inner diameter of said ultrasonic vibratory member of said hollow cylindrically shaped body.

20. A fuel supply system according to claim 4, wherein said wall member comprises a hollow cylinder having an inner diameter axially gradually decreasing, the smallest diameter thereof substantially coinciding with an inner diameter of said ultrasonic vibratory member of said hollow cylindrically shaped body.

21. A fuel supply system according to claim 19, wherein said hollow cylinder has a projecting portion having an inner diameter axially gradually increasing, the largest diameter thereof substantially coinciding with said inner diameter of said ultrasonic vibratory member of said hollow cylindrically shaped body.

22. A fuel supply system according to claim 8, wherein said intake passage is connected to internal combustion chambers of an internal combustion engine through intake valves, an opening duration and opening cycles of said injector being controlled in response to the running condition of said internal combustion engine, thereby allowing the intermittent supply of fuel in a predetermined flow rate in response to the running condition of said engine to said ultrasonic vibratory member in the form of a liquid film.

23. A fuel supply system according to claim 22, wherein said ultrasonic wave generating means comprises an ultrasonic wave transducer having piezoelectric elements and a mechanical vibration amplifying portion of a stepped type horn.

24. A fuel supply system according to claim 23, wherein said pressurizing and regulating means comprises a pump driven by a motor and having a suction port connected via a filter and pipes to said fuel tank, a pressure regulating valve connected to a discharge port of said pump, for controlling the pressure of fuel fed from said pump to a predetermined pressure level, and a computer connected to an air flow sensor provided at downstream of an air cleaner in said intake air passage, to an engine speed sensor provided at a part adjacent to a movable member of said engine, and to a cooling-water-temperature sensor interposed within a water jacket of a cylinder block of said engine, for computing a signal from said air flow sensor, a signal from said engine speed sensor, and a signal from said cooling-water-temperature sensor, and for supplying a predetermined pulse signal in response to said three signals.

25. A fuel supply system according to claims 2 or 24, wherein said injector comprises a swirl type injector comprising a hollow cylindrical nozzle body, a needle valve having a spiral groove at an outer peripheral wall thereof inserted within said hollow cylindrical nozzle body having a nozzle port, a coil spring for suppressing said needle valve, inserted within said nozzle body, and a solenoid connected to said computer and provided at an outer wall of said nozzle body in order to move reciprocably said nozzle body at a valve opening cycle and a valve opening duration of time in response to said pulse signal from said computer, said injector being provided coaxially in said intake passage.

26. A fuel supply system according to claim 25, wherein said ultrasonic wave generating means comprises an ultrasonic wave transducer having piezoelectric elements of a pair of PZT sandwiched between flanges of a backing block and said mechanical vibration amplifying portion by means of a reinforcing ring and four bolts, and said ultrasonic wave generating means is fixed to an outer wall of said intake passage through said reinforcing ring and bolts so that said ultrasonic vibratory member is coaxially provided at a near downstream part of said injector within said intake passage.

27. A fuel supply system according to claim 7, wherein said intake passage is connected to internal combustion chambers of an internal combustion engine through an intake valve, said injector comprises a swirl type injector comprising a cylindrical vortex chamber connected to a nozzle port provided at a hollow cylindrical nozzle body, two openings provided in a wall of said vortex chamber in the tangential direction thereof so as to tangentially inject fuel within said vortex chamber through said openings, and a nozzle port having a predetermined diameter provided coaxially with said vortex chamber at a bottom portion of said nozzle body, said injector being provided downstream of a throttle valve in said intake passage, and said ultrasonic wave generating means comprises an ultrasonic wave transducer having a magnetostrictive element, and a mechanical vibration amplifying portion of a stepped type horn.

28. A fuel supply system according to claim 27, wherein said pressurizing and regulating means comprises: a pump driven by a motor, having a suction port connected via a filter and pipes to said fuel tank; a pressure regulating valve connected to a discharge port of said pump, for controlling the pressure of fuel fed from said pump to a predetermined pressure level; an air valve which comprises a disc member rotatably supported between an air cleaner and said throttle valve in said intake passage; first and second chambers divided by a diaphragm, said first chamber being connected upstream of said intake passage, said second chamber being connected downstream of said intake passage, and said diaphragm being connected to said disc member through a bar; a flow rate regulating valve which comprises a hollow cylinder having suction and discharge ports; a spool inserted within said hollow cylinder, having a diverging groove extending along a circumference thereof; a first link having a length-adjusting mechanism secured to said spool; an arm which is rotatably supported and connected to said first link at a lower end thereof and a second link engaging said disc member; and a coil spring at an upper end thereof, said suction port of said hollow cylinder being connected to said pressure regulating valve and said discharge port of said hollow cylinder being connected to said two openings of said injector, and said ultrasonic wave generating means comprises a magnetostrictive transducer having a U-shaped core and a lead wire wound in a predetermined number of turns around two leg portions, said lead wire being connected to said ultrasonic wave oscillator, and said ultrasonic wave generating means is fixed to an outer wall of said intake passage through a flange part of said stepped type horn by an annular plate and bolts so that said ultrasonic vibratory member of a hollow cylinder is coaxially provided at a near downstream of said injector within said intake passage.

29. A fuel supply system according to claim 3, wherein said intake air control means is provided at said intake passage connected to internal combustion chambers of an internal combustion engine through an intake valve, and comprises a movable member interposed within a cylindrical concave portion of a wall of said intake passage, a stationary member comprising a projection of a wall of said intake passage, a coil spring interposed within said movable member and a bottom part of said cylindrical concave portion, and a link mechanism connected to an accelerator pedal through a throttle wire and said movable member for lifting said movable member in response to the amount of pushdown of said accelerator pedal, longitudinal sections and side surfaces of said movable member and stationary member being of convex shapes having predetermined curvatures suitable for introducing intake air efficiently, said movable member and stationary member being positioned in opposed relation to each other, thereby defining a throat of a rectangular variable opening area in cooperation with straight convex surfaces of said movable and stationary members.

30. A fuel supply system according to claim 29, wherein said injector is provided at the downstream of said intake air control means in said intake passage, and comprises a hollow cylindrical nozzle body connected to an L-shaped pipe, a needle valve having a spiral groove at an outer peripheral wall thereof inserted within said nozzle body having a nozzle port, said pressurizing and regulating means comprises a pump driven by a motor, having a suction port connected via a filter and pipes to said fuel tank, a pressure regulating valve connected to a discharge port of said pump, for controlling the pressure of fuel fed from said pump to a predetermined pressure level, a fuel flow rate adjusting means comprising a hollow cylinder having suction and discharge ports, a spool having a diverging groove extending along a circumference thereof inserted within said hollow cylinder and connected to an arm rotated in response to movement of said link mechanism of said intake air control means through a lever, said suction port of said hollow cylinder being connected to said pressure regulating valve and said discharge port of said hollow cylinder being connected to said injector through said L-shaped pipe, and said ultrasonic wave generating means comprises an ultrasonic wave transducer having a piezoelectric elements of a pair of PZT sandwiched between flanges of a backing block and said mechanical vibration amplifying portion by means of a reinforcing ring and four bolts, and said ultrasonic wave generating means is fixed to an outer wall of said intake passage through said reinforcing ring and bolts so that said ultrasonic vibratory member is coaxially provided at a near downstream part of said injector within said intake passage.

31. A fuel supply system according to claim 3, wherein said intake air control means is provided at said intake passage connected to internal combustion chambers of an internal combustion engine through an intake valve, and comprises a pair of devices each comprising a movable member interposed within a cylindrical concave portion of a wall of said intake passage, a coil spring interposed within said movable member and a bottom part of said cylindrical concave portion, and a link mechanism connected to an accelerator pedal through a rotatable arm and a common throttle wire and to said movable member, for lifting said movable member in response to the amount of pushdown of said accelerator pedal, the longitudinal section and side surfaces of said movable member being of convex shapes having a predetermined curvature suitable for introducing intake air efficiently, and said movable members being positioned in opposed relation to each other thereby defining a throat of a rectangular variable opening area, the center line of which coincides with the axis of said intake passage, in cooperation with straight convex surfaces of said opposed movable members.

32. A fuel supply system according to claim 19, wherein said intake passage is connected to internal combustion chambers of a gasoline engine through intake valves, said hollow cylinder as said wall member is coaxially provided at the downstream of a throttle valve in said intake passage by four rectangular supporting members, said ultrasonic wave generating means comprises an ultrasonic wave transducer having piezoelectric elements of a pair of PZT sandwiched between flanges of a backing block and said mechanical vibration amplifying portions by means of a reinforcing ring and four bolts, and said ultrasonic wave generating means is fixed to an outer wall of said intake passage through said reinforcing ring and bolts so that said ultrasonic vibratory member is coaxially provided at a near downstream part of said injector within said intake passage, said pressurizing and regulating means comprises a pump driven by a motor and having a suction port connected via a filter and pipes to said fuel tank, a pressure regulating valve connected to a discharge port of said pump, for controlling the pressure of fuel fed from said pump to a predetermined pressure level, and a computer connected to a pressure sensor provided at a bypass passage connected to the downstream of said intake passage and to an engine speed sensor provided at a part adjacent to a movable member of said engine, for computing signals from said pressure sensor and said engine speed sensor and for supplying a DC voltage signal in response to said signals, and said injector comprises a hollow nozzle body penetrated within said hollow cylinder, a needle valve inserted within said hollow nozzle body, a nozzle port provided at a tip portion of said nozzle body and tangentially and downwardly opened to an inner wall of said wall member and a solenoid connected to said computer and provided at an outer wall of said nozzle body in order to control the opening area of said nozzle port and needle valve in response to said DC voltage signal from said computer.

33. A fuel supply system according to claim 20, wherein said intake passage is connected to internal combustion chambers of a gasoline engine through intake valves, said wall member comprises a throttled part of said intake passage having an inner diameter axially gradually decreasing at the downstream of a throttle valve in said intake passage, said ultrasonic wave generating means comprises a magnetostrictive transducer having a U-shaped core and a lead wire wound in a predetermined number of turns around two leg portions and connected to said ultrasonic wave oscillator, a Fourier type horn fixed to an outer wall of said intake passage by supporting members and bolts and an ultrasonic member of a hollow cylinder coaxially provided at the downstream of a smallest part of said throttled intake passage, said pressurizing and regulating means comprises a fuel pump, the rotational speed of which is controlled by an electric signal from an air flow meter provided downstream of said throttle valve in said intake passage, thereby pressurizing the fuel from said fuel tank and supplying the fuel, the flow rate of which is regulated in accordance with the amount of said sucked intake air, and said injector comprises two nozzle means which are provided at diametrically opposed points in an inner wall of larger diameter of said wall member, which are opened tangentially and horizontally to said inner wall of said wall member and which are connected to said fuel pump.

34. A fuel supply system according to claim 21, wherein said intake passage is connected to internal combustion chambers of a gasoline engine through intake valves, said wall member comprises a cylindrical intake passage wall having a constant inner diameter in the axial direction thereof and said projecting portion, said ultrasonic wave generating means comprises an ultrasonic wave transducer having piezoelectric elements of a pair of PZT sandwiched between flanges of a backing block and said mechanical vibration amplifying portion which is fixed to an outer wall of said intake passage through a U-shaped section member and a reinforcing ring by means of four bolts, a catenary type horn as said mechanical vibration amplifying portion and an ultrasonic vibratory member of a hollow cylinder coaxially provided at a part adjacent to said projecting portion of said wall member, said pressurizing and regulating means comprises an injection carburetor having first and second chambers divided by a diaphragm pressed by a tension coil spring inserted within a feed back chamber, said first chamber being connected to the atmosphere and said second chamber being connected to a venturi provided in said intake passage, a needle valve connected to said diaphragm; a pump driven by a motor, having a suction port connected via filter and pipes to said fuel tank; a pressure regulating valve connected to a discharge port of said pump for controlling the pressure of fuel fed from said pump to a predetermined pressure level; a pressure regulating chamber in which said needle valve is inserted and which is connected to said pressure regulating valve through pipes and said feedback chamber through a pipe; and a discharge pressure control device connected to said valve seat, and said injector comprises an opening provided at an inner wall of said intake passage forming said wall member and connected to said discharge pressure control device through a passage.

* * * * *

UNITED STATES PATENT AND TRADEMARK OFFICE

CERTIFICATE OF CORRECTION

PATENT NO. : 4,237,836

DATED : December 9, 1980

INVENTOR(S) : YASUSI TANASAWA ET AL.

It is certified that error appears in the above—identified patent and that said Letters Patent is hereby corrected as shown below:

Please insert the following Foreign Application Priority Data:

[30]--Foreign Application Priority Data

May 12, 1977 Japan.....52/55097

Signed and Sealed this

Ninth Day of June 1981

[SEAL]

Attest:

RENE D. TEGTMEYER

Attesting Officer

Acting Commissioner of Patents and Trademarks